US005608361A

United States Patent [19]

Weiss et al.

[11] Patent Number: 5,608,361

[45] Date of Patent: Mar. 4, 1997

[54] ADVANCED RING-NETWORK CIRCULATOR

[75] Inventors: Jerald A. Weiss, Wayland; Gerald F. Dionne, Winchester, both of Mass.

[73] Assignee: Massachusetts Institute of Technology, Cambridge, Mass.

[21] Appl. No.: 441,428

[22] Filed: May 15, 1995

[51] Int. Cl.[6] ..... H01P 1/387

[52] U.S. Cl. ..... 333/1.1; 333/128; 333/24.1

[58] Field of Search ..... 333/1.1, 24.1

[56] References Cited

U.S. PATENT DOCUMENTS

| | | | |
|---|---|---|---|
| 3,277,400 | 10/1966 | Digiondomenico et al. | 333/1.1 |
| 3,304,519 | 2/1967 | Weiss | 333/1.1 |
| 4,801,901 | 1/1989 | Ayasli | 333/1.1 X |
| 4,918,409 | 4/1990 | Lamberty | 333/1.1 |

OTHER PUBLICATIONS

Weiss, J.A., "Circulator Synthesis," *IEEE Transactions on Microwave Theory and Techniques,* vol. MTT-13(13):38–44 (Jan., 1965).

Ewing, S.D., "Ring Circulator Theory, Design, and Performance," *IEEE Transactions on Microwave Theory and Techniques,* vol. MTT-15(11):623–628 (Nov., 1967).

Sherman, M., "Stripline Ferrite Devices," *Technical Report No. RADC-TR-68-71,* Griffiss Air Force Base, New York (Jan., 1968).

Roome, G.T., "Thin Ferrites for Integrated Microwave Devices," *Technical Report AFAL-RT-69-149, Wright-Patterson Air Force Base,* Ohio (Jul., 1969).

Knerr, R.H., "A Lumped-Element Circulator Without Crossovers," *IEEE Transactions on Microwave Theory and Techniques,* vol. MTT-22 (5):544–548 (May, 1974).

Helszajn, J., "A Ferrite Ring Stripline Junction Circulator," *The Radio and Electronic Engineer,* vol. 32(1):55–60 (Jul., 1966).

*Primary Examiner*—Paul Gensler

*Attorney, Agent, or Firm*—Hamilton, Brook, Smith & Reynolds, P.C.

[57] ABSTRACT

In an apparatus and method for forming an advanced ring-network circulator, a plurality of junctions are interconnected by a plurality of non-reciprocal phase shifters. Each junction has a predetermined inductive reactance and capacitive susceptance which renders each junction partially reflective of an incident signal in a predetermined frequency-dependent manner. The junctions are selected such that a predetermined combination of average phase shift and differential phase shift provided between junctions produces substantially ideal circulation about a designated band center, the band center being determined by the selected reactance and susceptance of the junctions. The phase shifters are selected to provide an ideal combination of average phase shift and differential phase shift for providing substantially ideal circulation within a frequency band about the band center in a predetermined frequency dependent manner. The invention is amenable to miniaturization, operation with self-biased and reversible magnetic structures, and operation with superconducting components.

51 Claims, 17 Drawing Sheets

ADVANCED RING-NETWORK CIRCULATOR

GOVERNMENT SUPPORT

The Government has rights in this invention pursuant to Contract Number F19628-95-C-0002 awarded by the United States Air Force.

BACKGROUND OF THE INVENTION

The circulator is basic to both theory and practical applications of nonreciprocity in electromagnetic systems. Microwave junction circulators have become widely employed in waveguide and coaxial versions and, in recent years, in planar stripline embodiments due to the exploitation of planar, miniature, and integrated circuits. The three-port ring-network circular was introduced as a theoretic formulation in 1965.

Weiss, J. A., "Circulator Synthesis"*IEEE Trans. MTT* 13, 38–44 (Jan., 1965)

experimental verification in 1967:

Ewing, S. D. and Weiss, J. A., "Ring Circulator Theory, Design and Performance"*IEEE Trans. MTT* 15, 623–628 (Nov., 1967)

and issued as a patent in 1967:

U.S. Pat. No. 3,304,519, issued Feb. 14, 1967 to Weiss, J. A., incorporated herein by reference.

The specific embodiment considered in the 1965 study was a ring comprising three identical non-reciprocal phase shifters connected by three identical, symmetrical, reciprocal T-junctions, constituting a three-port junction circulator. Computations performed for a range of examples demonstrated that circulation is achievable with unexpectedly small requirements for nonreciprocity in the sectors between T-junctions. At the time of the first publications, the potential advantages of the ring network were not apparent, as compared with the supposed disadvantages of loss and complexity suggested by those initial designs. In addition, exploitation of the concepts of planar circuits, integration, and miniaturization were in an infant stage of development. For these reasons, the theory proposed in 1965 has received only slight attention from of the microwave non-reciprocal device community.

The ring network circulator disclosed in 1965 was dismissed as "significantly large and more complicated" than a lumped-element circulator because the "ring circulator uses three delta connected non-reciprocal phase shifters": Knerr, R. H., "A Lumped-Element Circulator Without Crossovers", IEEE Trans MTT, Vol. 22, pp. 544–548 (May, 1974). In another study, three meanderline non-reciprocal phase shifters were combined in a ring by three T-junctions, and the combination was deposited on a ferrite disk: Sherman M., "Stripline Ferrite Devices", Syracuse University Research Corporation—Special Projects Laboratory, Tech Rep. No. RADC-TR-68-71 (Jan, 1968), AD No. 827769. The study resulted in a circulator having unfavorable characteristics: "2 dB insertion loss and a bandwidth of approximately 2%", concluding that "It appears doubtful that bandwidth greater than 10% can be obtained from the ring circulator."

SUMMARY OF THE INVENTION

In recent years, dramatic advances in miniature microwave circuits and thin deposited ferrite films, and low-loss high-temperature superconducting planar circuits warranted a new investigation into the virtues and features of the ring network circulator. In view of this, the present invention recognizes a relationship between the inductive reactance and capacitive susceptance at the T-junctions and the differential phase shift $\delta$ and average phase shift $\epsilon$ of the non-reciprocal phase shifters interconnecting the junctions. If the phase shifters are designed in accordance with this relationship, then the bandwidth of the circulator can be increased, with no theoretical limit on the bandwidth.

The present invention is directed to an apparatus and method for forming an electromagnetic device. The apparatus of the invention comprises a plurality of junctions. Each junction includes an external port for transmitting and receiving electromagnetic signals. Each junction has a predetermined inductive reactance and capacitive susceptance, rendering each individual junction partially reflective of incident signals in a predetermined frequency-dependent manner. The reactance and susceptance of the junctions are selected such that a predetermined combination of average phase shift represented by average phase shift factor $\epsilon$ and differential phase shift, represented by differential phase shift factor $\delta$, if provided between junctions, would produce substantially ideal circulation at a designated band center. The selected reactance and susceptance determine the band center of the device. The device further comprises a plurality of non-reciprocal phase shifters electrically interconnecting the junctions. The phase shifters provide an ideal combination of phase factors $\epsilon$ and $\delta$ which would result in substantially ideal circulation within a frequency band about the band center in a predetermined frequency dependent manner. The interconnected junctions and phase shifters form a circulator which produces substantially ideal circulation of a signal incident on an external port, the signal being of frequency within the band. The reflected signals of the junctions substantially reinforce each other at an adjacent external transmitting port and substantially cancel each other in the remainder of the junctions, thereby providing substantially ideal circulation.

In a preferred embodiment, the non-reciprocal phase shifters comprise delay lines for electrically interconnecting the junctions. A magnetic structure is disposed proximal to the delay lines having a magnetization which interacts with the magnetic field of the electromagnetic signals-traversing the delay lines. This induces phase shift in the signal, the magnitude of which is dependent on the direction of propagation of the signals, such that the phase shift is non-reciprocal. The delay lines may comprise meanderlines oriented radially or tangentially about the ring network, comb filters, or other structures performing the same function. The magnetic structure may be formed in the shape of a toroid such that the magnetic flux is substantially confined within the structure. In this way, if superconducting components are used for the phase shifters and T-junctions, the flux will not substantially permeate the superconductor, thereby preserving the superconducting state of the conductive circuit elements. A latching wire may be disposed through a hole in the magnetic structure for controlling the direction and strength of the magnetization of the structure.

It is preferred that the inductive reactance and capacitive susceptance of each junction are selected to minimize the differential phase shift arg($\delta$) required between junctions to produce substantially ideal circulation at the designated band center, thereby minimizing the ferrite size, and losses due to the phase shifters. The junctions may comprise T-junctions or Y-junctions and may be loaded in various ways including recognizable or abstract equivalent structures to produce the frequency-dependent scattering effect/ of capacitors or inductors.

BRIEF DESCRIPTION OF THE DRAWING DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF PREFERRED EMBODIMENTS

In accordance with the present invention, a wide range of circulator designs is presented which demonstrates significant potential for very broad bandwidth and highly efficient use of gyrotropic materials in a compact planar design with favorable structure for many useful modes of operation including reversible and permanently self-magnetized versions.

Figure 1:
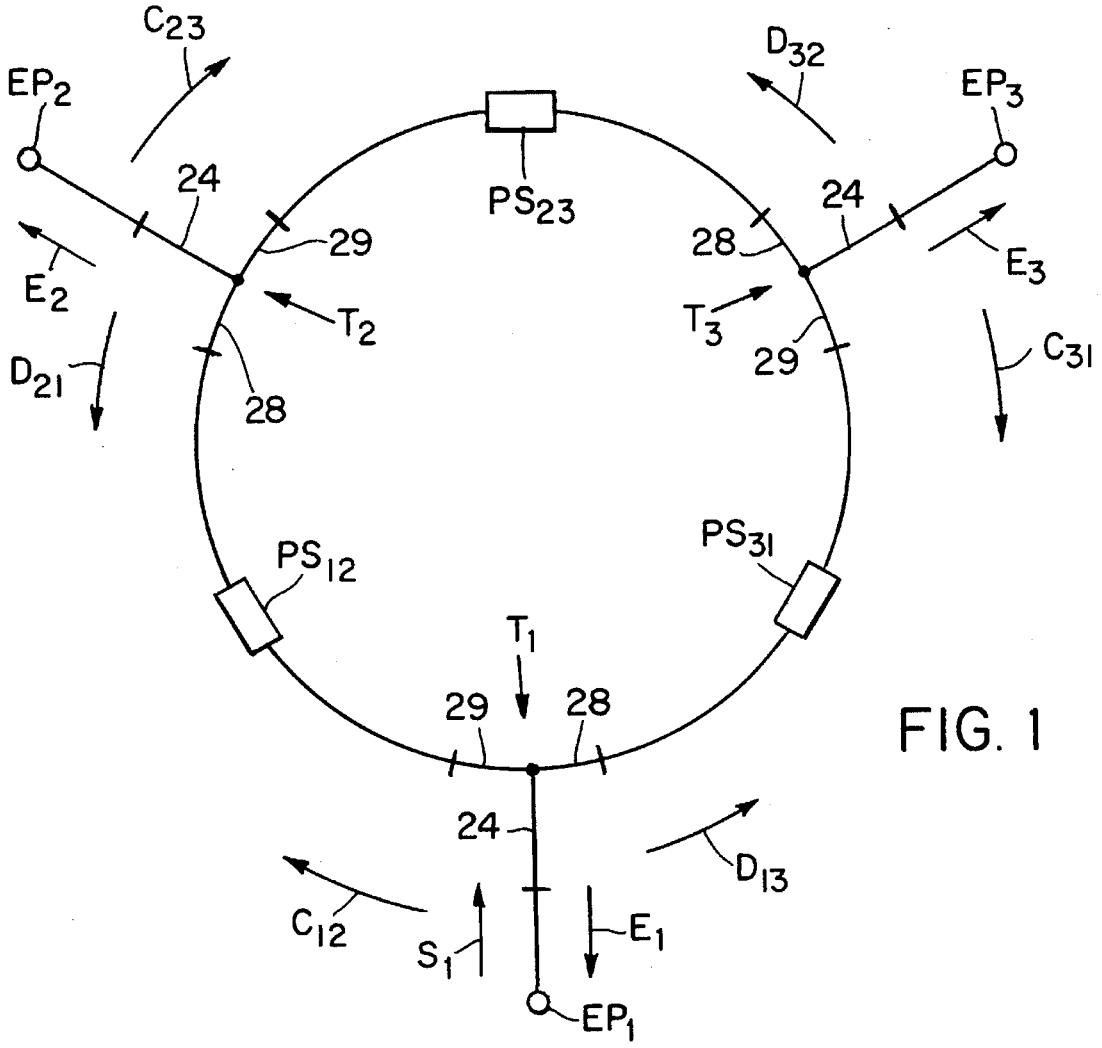
FIG. 1 is a schematic block-diagram representation of a ring-network circulator in accordance with the present invention.

FIG. 1 is a schematic representation of a three port ring network circulator in accordance with the present invention. The circulator comprises a plurality of multi-port junctions $T_1$, $T_2$, $T_3$. Each junction 15 is comprised of an external port 24 and two internal ports 28,29. In the case where the two internal ports 28,29 are symmetric, the junction is referred to as a "T-junction". Where the two internal ports 28,29 and external port 24 are symmetric, the junction is referred to as a "Y-junction". An external port 24 of each junction $T_1$, $T_2$, $T_3$ is electrically coupled with a terminal $EP_1$, $EP_2$, $EP_3$. Internal ports 28,29 of the T-junctions are electrically coupled with non-reciprocal phase shifters $PS_{12}$, $PS_{23}$, $PS_{31}$, forming a ring of three junctions and three phase shifters. This architecture is referred to as a "ring network circulator". This architecture is not to be confused with the "ring circulators" of the prior art, which were of the well-known resonant or Bosma type, referred to as "ring circulators" because the ferrite for inducing non-reciprocal phase shift was in the shape of a ring rather than a conventional disc.

Insertion loss, isolation, and input match over the band of interest are determined by the circulator scattering coefficients $E_1$, $E_2$, $E_3$. If an electromagnetic signal $S_l$ is injected into the terminal $EP_l$ of junction $T_1$, then ideal circulation is defined by zero reflection $E_1$ at the input terminal $EP_1$, zero leakage $E_3$ at the isolated terminal $EP_3$, and complete transmission $E_2$ of the signal $S_1$ at the transmission terminal $EP_2$. Thus, the conditions for an ideal circulator, circulating clockwise as seen in FIG. 1 with electromagnetic signals $S_1$ being launched into input terminal $EP_1$ are as follows:

$$E_1=0,\ |E_2|=1,\ E_3=0 \tag{1}$$

The resulting emerging wave amplitudes $E_1$, $E_2$, $E_3$ may be considered the net effect of a superposition of a set of partial internal waves within the ring as shown in Appendix II of "Circulator Synthesis" by J. A. Weiss, cited above. Clockwise and counter-clockwise propagating waves are defined in each of the three sectors of the circulator, whose amplitudes are designated $C_{12}$ (clockwise) and $D_{21}$ (counter-clockwise) in the sector between terminals $T_1$ and $T_2$ and similarly for the sectors defined between terminals $T_2$ and $T_3$, and $T_3$ and $T_1$. Each of the waves is a partial wave resulting from a combination of reflections and transmissions at each T-junction $T_1$, $T_2$, $T_3$. The superposition of waves at the isolated terminal $EP_3$, corresponding with T-junction $T_3$, consists of $C_{23}$ and $D_{13}$ multi-plied by the appropriate phase factor of the phase shifters and the scattering coefficient $s_d$ of the T-junctions $T_3$ (discussed below):

$$E_3=s_d(C_{23}e^{-j\phi+}+D_{13}e^{-j\phi-}).$$

For perfect isolation, the superposition of waves preferably cancel at the terminal $T_3$ so that the emitted wave $E_3=0$ at the isolated terminal $EP_3$. Similarly, at the input terminal $EP_1$, the superposition of waves results in an emitted wave $E_1$ which is preferably equal to 0:

$$E_1=r_d+s_d(C_{31}\ e^{-j\phi+}+D_{21}e^{-j\phi-}).$$

At the transmission terminal $EP_2$, the superposition of waves preferably reinforce each other, creating an interference maximum of signal $E_2$ preferably to a magnitude of 1:

$$E_2=s_d(C_{12}e^{-j\phi+}+D_{32}e^{-j\phi-}).$$

$$|E_2|=1$$

Figure 6:
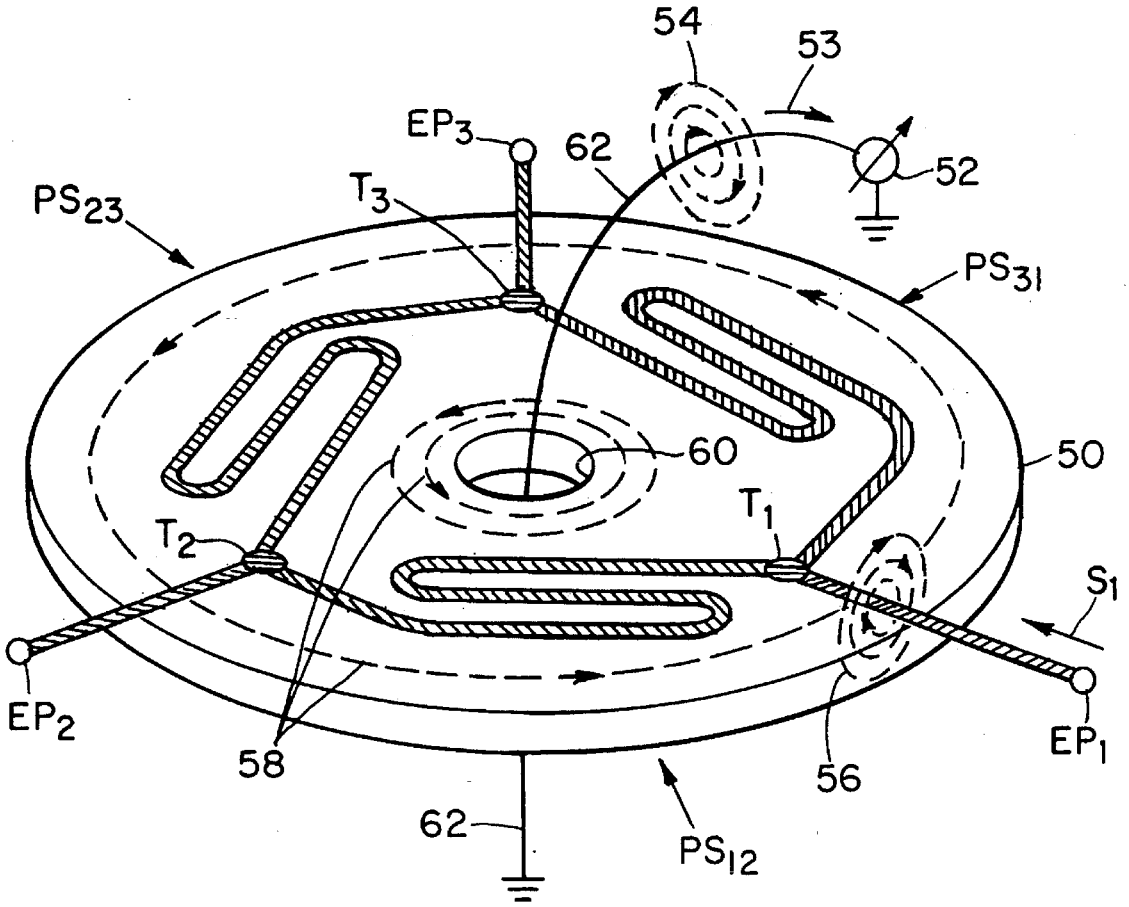
FIG. 6 is a perspective view of a stripline ring-network circulator demonstrating the interaction of electromagnetic signals traversing the circulator and the magnetization of the ferrite in accordance with the present invention.

FIG. 6 is a perspective view of a preferred embodiment of an advanced ring-network circulator in accordance with the present invention. A planar ferrite member 50 is formed in the shape of an annular disk having a hole 60 at or near its center. A ring-network of three T-junctions $T_1$, $T_2$, $T_3$ and three meanderline phase shifters $PS_{12}$, $PS_{23}$, $PS_{31}$ coupled as described above in conjunction with FIG. 1 are disposed about the hole 60. A latching wire 62 is disposed through the hole. The wire 62 preferably comprises a coil which is wrapped through the hole several times. A power supply 52 induces a current 53 in the latching coil 62. The current generates a magnetic field 54 around the latching coil 62, which in turn induces a tangential magnetization 58 in the toroidal ferrite ring 50. Note that for purposes of the present invention, the term "toroid", when used to describe the shape of magnetic structures, includes any continuous, closed-loop structure within which magnetic flux is substantially confined. The magnetic field 54 magnetizes the magnetic structure 50 by aligning its magnetic dipoles to form a resultant magnetization which remains after the magnetic field 54 induced by the coil current 53 is removed. In other words, the magnetization of the ferrite toroid 50 is remanent. The direction of magnetization 58 is reversible and therefore switchable, by reversing the direction of current 53 induced in the latching coil 62. In this way, the sense, clockwise or counter-clockwise of circulation between external ports $EP_1$, $EP_2$, $EP_3$ can be reversed and switched by the latching coil 62.

A ferrite is a gyrotropic medium that can influence the propagation of an electromagnetic wave or signal. At high frequencies, including the microwave and millimeter-wave bands, gyromagnetic interaction occurs between the magnetic field component of an electromagnetic wave traversing the ferrite and the magnetization of the ferrite. At a specific frequency, the interaction becomes resonant and the electromagnetic wave is absorbed by the ferrite across a narrow band about the resonance frequency. The absorption effect is the basis for frequency filters and resonant isolators (resonant devices). At frequencies away from the gyromagnetic resonance condition, the absorption becomes negligible, but a phase shift which is dependent on the magnetic parameters of the gyrotropic medium remains in the electromagnetic wave. This phase shift effect is the basis for phase shifters and circulators (non-resonant devices).

A significant advantage of the ring network circulator of the present invention is that it lends itself to designs with ferrite magnetized either in its plane or perpendicular, whereas prior junction circulators of the conventional resonant or Bosma type require perpendicular magnetization: Bosma, H., "On Stripline Y-Circulation at UHF", IEEE Trans. MTT Vol. 12, pages 61–72 (January, 1964). To be latched or self-biased when magnetized perpendicular to its plane, the ferrite must be of the permanent or high-coercivity type—a special and limited class of materials because it is required in order to overcome the effect of the surface magnetic poles which create a high reverse internal demagnetizing field. When magnetized in the plane, the internal demagnetizing field is very small or absent, and many advantageous ferrites are eligible for use though they generally have low coercivity. Low coercivity also means that switchable or reversible circulators may be operated or switched with low energy requirements, whereas conventional circulators having perpendicular magnetization require relatively large, heavy, high-energy reversing structures. Magnetization in the plane also means that designs of that type, available in the ring network circulator, can be made with use of superconducting circuits and there is little or no external field to disrupt the superconducting condition of the components. Conventional circulators might be made with superconducting circuits, but only with use of high coercivity ferrites or high externally applied magnetic fields, and that with considerably greater design difficulty.

As an electromagnetic signal, $S_l$ enters the input terminal $EP_1$, an electromagnetic field 56 is established about the conductor which carries the signal $S_1$. The electromagnetic field 56 of the signal $S_1$ interacts gyromagnetically with the magnetization 58 induced in the toroidal magnetic structure 50 as the signal $S_1$ traverses the meanderline phase shifters $PS_{12}$, $PS_{23}$, $PS_{31}$ causing the phase of the signal $S_1$ to shift in proportion to the strength of the interaction. Because the magnetic flux 58 is confined almost entirely within the toroidal magnetic structure 50, almost none of the magnetic flux 58 permeates the T-junctions $T_1$, $T_2$, $T_3$ and phase shifters $P_{12}$, $PS_{23}$, $PS_{31}$. Thus, if the T-junctions and phase shifters are formed of superconducting material operating in a superconducting state, a phase shift can be induced in the signal $S_1$ as it propagates through the meanderline phase shifters without interfering with the superconducting properties of the components because almost none of the magnetic flux 58 permeates the superconductor. Thus, gyrotropic interaction occurs between the ferrite 50 and the superconducting components of the ring-network circulator without adversely affecting the advantageous reduced conductive loss of the superconductors.

The present invention is operable with any form of non-reciprocal phase shifter, such non-reciprocal properties being derived from creation of elliptical polarization of a signal transversing therethrough. FIGS. 7–10 are top views of laboratory embodiments of the present invention employing various forms of non-reciprocal phase shifters. Note that in actual integrated circuit designs, the coaxial transducers shown in laboratory test models illustrated in FIGS. 7–11 would not be present. Each embodiment shown includes three terminals $EP_1$, $EP_2$, $EP_3$. The terminals comprise standard coaxial connectors 66 attached to a metallic circulator frame 68. The center conductor of the coaxial cable is electrically coupled to the external port of each respective T-junction $T_1$, $T_2$, $T_3$. The internal ports of the T-junctions are coupled to various forms of phase shifters $PS_{12}$, $PS_{23}$, $PS_{31}$ forming a ring-network circulator. The ring network is disposed over a ferrite material 50 as described above.

Figure 7:
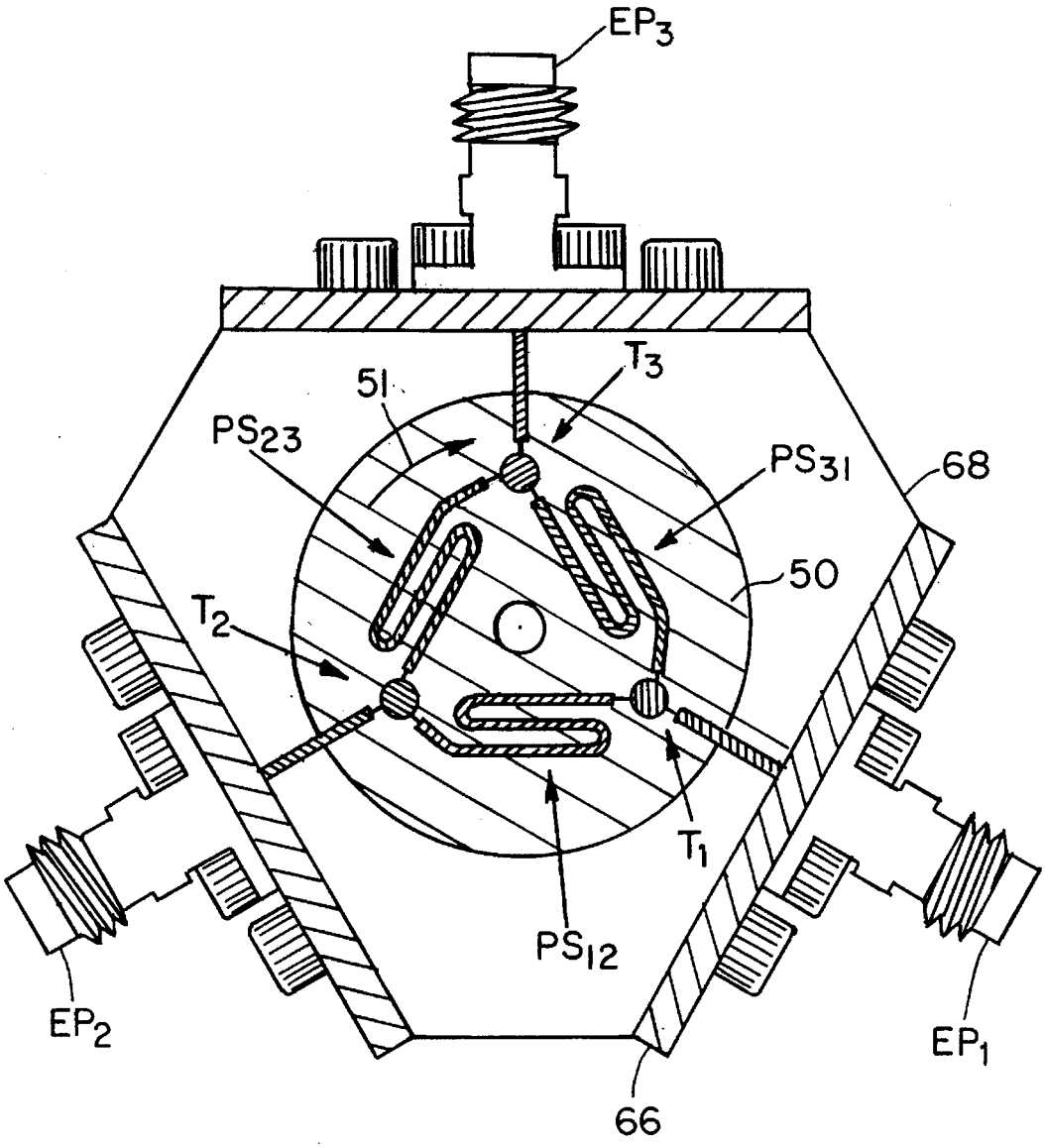
FIG. 7 is a top view of a ring-network stripline circulator having tangentially-oriented meanderline phase shifters in accordance with the present invention.

In FIG. 7, the phase shifters $PS_{12}$, $PS_{23}$, $PS_{31}$, comprise meanderlines oriented tangentially with respect to the center of the ring network. The ring network is disposed above a ferrite toroid 50 magnetized tangentially either clockwise or counter-clockwise in the direction of arrow 51. The magnetization direction 51 is reversible by a switching coil (not shown) as described above.

Figure 8:
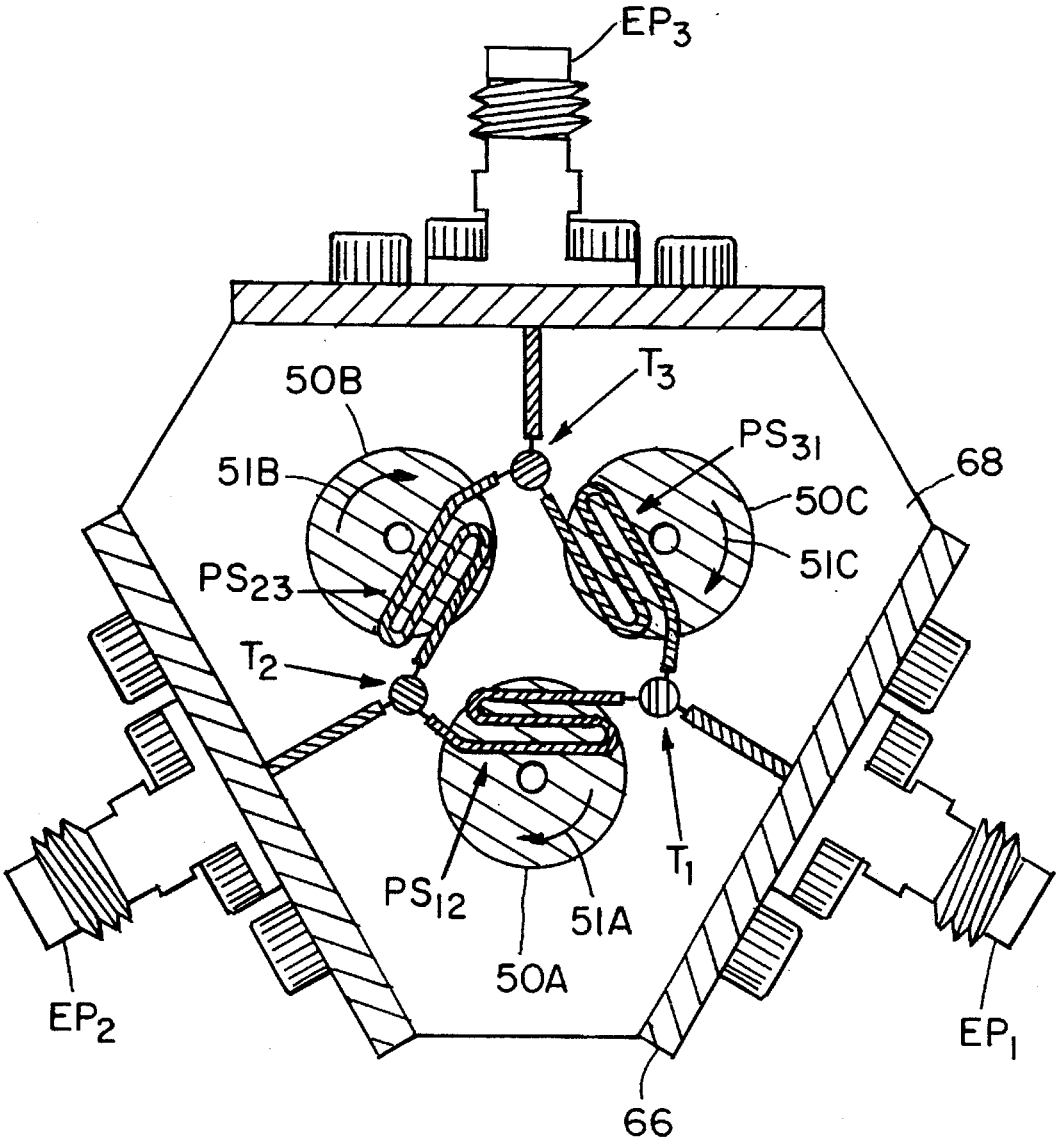
FIG. 8 is a top view of a stripline ring-network circulator having separate ferrite toroids for inducing non-reciprocal phase shift in each meanderline phase shifter in accordance with the present invention.

In FIG. 8, each phase shifter $PS_{12}$, $PS_{23}$, $PS_{31}$ has a corresponding ferrite toroid 50A, 50B, 50C magnetized tangentially as shown by arrows 51A, 51B, 51C. This reduces the amount of ferrite required for non-reciprocal phase shift and also lowers the current required by the latching wires for reversing the magnetization direction. Each ferrite toroid 50A, 50B, 50C could be separately or jointly latched in this configuration.

Figure 9A:
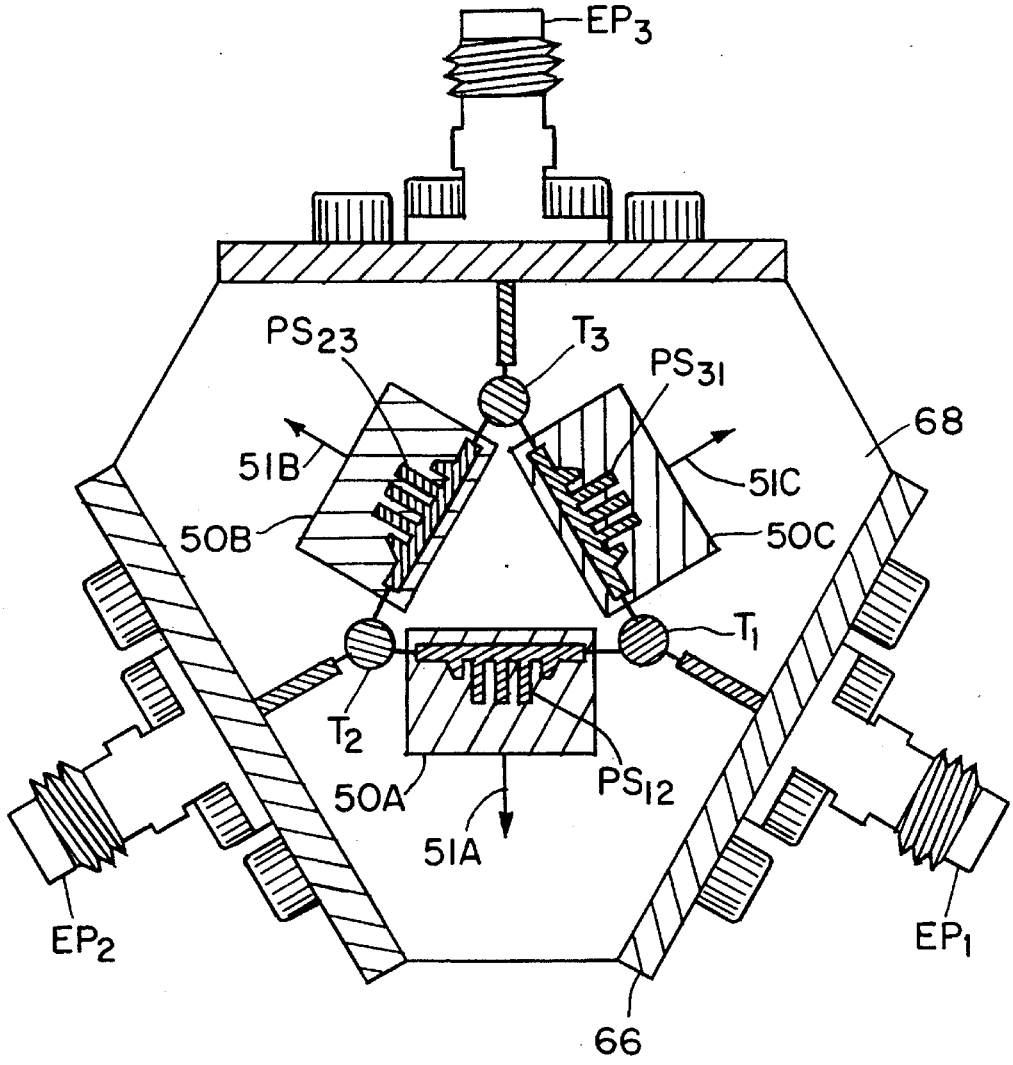
FIG. 9A is a top view of a ring-network stripline circulator having comb-filters as non-reciprocal phase shifters and radially-magnetized ferrite structures in accordance with the present invention.
Figure 9B:
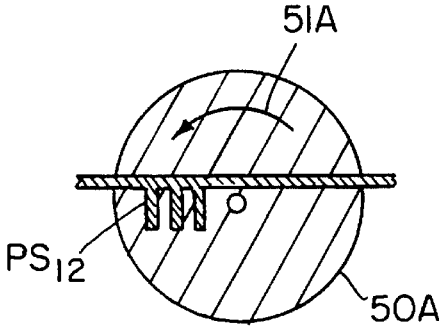
FIG. 9B is a top view of the circulator of FIG. 9A employing a toroidal ferrite structure.

The FIG. 9A embodiment includes comb filters similar to those described in U.S. Pat. No. 3,304,519 for inducing non-reciprocal phase shift $PS_{12}$, $PS_{23}$, $PS_{31}$. Separate ferrite members 50A, 50B, 50C are included for each phase shifter. The ferrite members are magnetized radially as shown by arrows 51A, 51B, 51C so that the magnetization is aligned with the teeth of the comb for proper non-reciprocal interaction. The radially magnetized ferrite members 50A, 50B, 50C may comprise either a flat plate of self-biased high coercivity material, or may comprise a three-dimensional structure of low coercivity material with a return path below for closing the magnetization path. Alternatively, the ferrite members may be toroidal in shape, magnetized tangentially as shown in FIG. 9B. The configuration of FIG. 9B is appropriate for reversible embodiments.

Figure 10A:
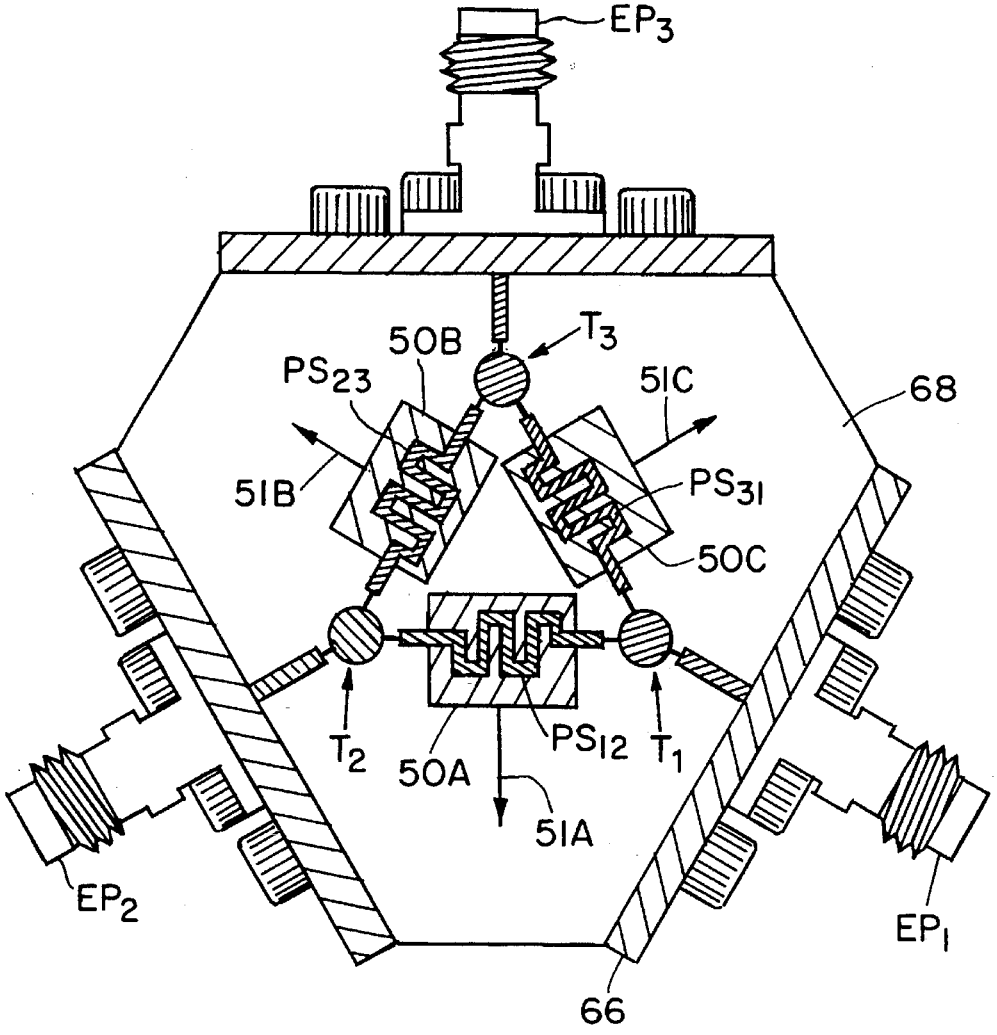
FIG. 10A is a top view of a ring-network stripline circulator having radially-oriented meanderline phase shifters and radially-magnetized ferrite structures in accordance with the present invention.
Figure 10B:
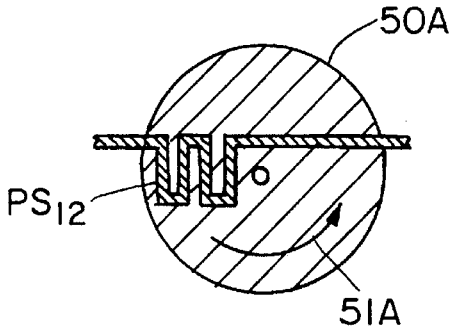
FIG. 10B is a top view of the circulator of FIG. 10A employing a toroidal ferrite structure.

The FIG. 10A embodiment includes radially-oriented meanderlines $PS_{12}$, $PS_{23}$, $PS_{31}$. Separate ferrite members 50A, 50B, 50C are provided for each meanderline. The ferrite members are magnetized radially as shown by arrows 51A, 51B, 51C so that the magnetization direction aligns with the meanderlines. Alternatively, toroidal ferrite members may be used as shown in FIG. 10B, for reversible applications.

The general 3-port transmission-line T-junction is characterized by a 3×3-dimensional scattering matrix with nine complex elements: thus, 18 real parameters. The constraints of geometrical symmetry and reciprocity reduce the number of complex elements to four in the case of a T-junction having two-fold symmetry:

$$S_T=\begin{pmatrix} r & s & s_d \\ s & r & s_d \\ s_d & s_d & r_d \end{pmatrix} \tag{3}$$

Figure 2A:
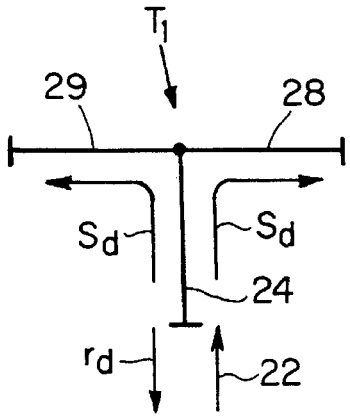
FIGS. 2A and 2B are schematic representations of a T-junction, defining the scattering coefficients thereof in accordance with the present invention.
Figure 2B:
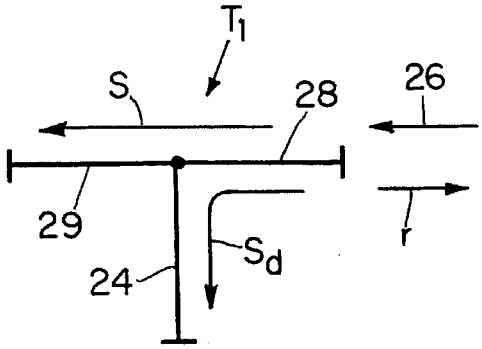

The scattering coefficients r, s, $s_d$, $r_d$ of the T-junction are defined in FIGS. 2A and 2B. In FIG. 2A, an electromagnetic signal 22 is incident upon external port 24 of one of the T-junctions, $T_1$, for example. In FIG. 2B, an electromagnetic signal 26 is incident upon one of the symmetrical internal ports 28 of the T-junction $T_1$. The scattering coefficient $r_d$ represents the proportional part (namely, electromagnetic field amplitude or voltage) of the electromagnetic signal 22 incident upon the external port 24 which flows back out that same external port 24. The scattering coefficient $s_d$ represents the proportional part of the electromagnetic signal 22 incident upon the external port 24 which flows through either symmetrical port of the T-junction $T_1$ toward an adjacent T-junction $T_2$ or $T_3$. The coefficient r represents the proportional part of an electromagnetic signal 26 incident upon one of the internal ports 28 of the T-junction $T_1$ which is reflected and flows back from that same symmetrical port 28. The coefficient s represents the proportional part of an electromagnetic signal 26 incident upon one of the internal ports 28 of the T-junction $T_1$ which flows out from the opposite symmetrical port 29 of the T-junction $T_1$.

As described in Appendix I of Weiss, J. A., "Circulator Synthesis", IEEE Trans. MTT (13), 38–44 (January, 1965), the further constraint of energy conservation results in the class of all lossless, symmetrical, reciprocal T-junctions being encompassed by four real parameters representing the phase angles $\sigma_a$, $\sigma_b$, $\sigma_c$, or arguments of three complex eigenvalues of unit magnitude $s_a$, $s_b$, $s_c$ for the matrix $S_T$ and the degeneracy parameter $\gamma$ which results from the symmetry of the internal ports of the T-junction:

$$r=\frac{1}{2}\,(s_a+s_b\cos^2\gamma+s_c\sin^2\gamma) \tag{4}$$

$$s=\frac{1}{2}\,(-s_a+s_b\cos^2\gamma+s_c\sin^2\gamma)$$

$$r_d=s_b\sin^2\gamma+s_c\cos^2\gamma$$

$$s_d=\frac{1}{\sqrt{2}}\,(s_b-s_c)\cos\gamma\sin\gamma$$

in which $|s_a|=|s_b|=|s_c|=1$; and $$s_a=e^{i\delta_a}$$

$$s_b=e^{i\delta_b} \tag{5}$$

$$s_c=e^{i\delta_c}$$

Each assignment of values to the four real parameters $\sigma_a$, $\sigma_b$, $\sigma_c$, and $\gamma$ within their respective finite ranges, yields a unique prescription for a suitable T-junction with four complex scattering coefficients $r_d$, $s_d$, r, s which forms the basis of an individual circulator design. Conversely, the scattering matrix of every lossless, symmetrical, reciprocal T-junction corresponds to a set of values of those four parameters $\sigma_a$, $\sigma_b$, $\sigma_c$, $\gamma$.

The non-reciprocal phase shifters $PS_{12}$, $PS_{23}$, $PS_{31}$ interconnecting the T-junctions (assumed matched) are characterized by two parameters; namely, the mean (or average) phase factor $\epsilon=\exp[-j(\phi_{30}+\phi_-)/2]$, and the (half) differential phase factor $\delta=\exp[-j(\phi_+-\phi_-)/2]$, where $\phi_+$ and $\phi_-$ are the respective phases for the clockwise and counterclockwise senses of propagation through one sector of the ring. Imposition of the circulation condition, namely unit input at input terminal $EP_1$ and isolation at the isolated terminal $EP_3$ (see FIG. 1), leads to an algebraic equation for $\epsilon^2$ and a formula for $\delta^3$ in terms of $\epsilon$. In both of these relations, the coefficients are functions of the "internal" scattering coefficients r and s of the T-junctions. Four parameters $a_0$, $a_1$, $a_2$, $a_3$, $a_4$ are defined as functions of r and s.

$$a_4=(r-s)^3(r+s) \tag{6}$$

$$a_3=-s\,(r-s)^2$$

$$a_2=-2r(r-s)$$

$$a_1=s$$

$$a_0=1.$$

The mean phase factor $\epsilon$ is a solution of $$L(\epsilon)=A_8\epsilon^8+A_6\epsilon^6+A_4\epsilon^4+A_2\epsilon^2+A_{0=0}, \tag{7}$$

where:

$$A_8=A_0^*=a_4a_0^*$$

$$A_6=A_2^*=a_4a_2^*+a_2a_0^*-a_3a_1^* \tag{8}$$

$$A_4=|a_4|^2+|a_2|^2+|a_0|^2-a_3|^2-|a_1|^2.$$

in which * denotes the conjugate of a complex number. In terms of the mean phase factor $\epsilon$, the corresponding value of the differential phase factor $\delta$ is given by:

$$\delta^3=\frac{a_4\epsilon^4+a_2\epsilon^2+a_0}{a_3\epsilon^3+a_1\epsilon}. \quad (9)$$

For the assumed ideal of perfect circulation, solutions of the above equations 7, 9 are subject to the conditions:

$$|\epsilon|=1,\ |\delta|=1. \quad (10)$$

Some useful symmetries in these basic relations are noteworthy: for a given solution $\epsilon$, Equation 7 is also satisfied by $-\epsilon$, and under such a phase change of arg($\epsilon$) by $\pm\pi$, or 180°, the sign of $\delta^3$ in Equation 9 is reversed Taking the cube root of the right-hand-side of Equation 9, for a given solution $\delta$, Equation 9 is also satisfied by arg($\delta$)=$\pm 2\pi/3$, or ±120°. The most significant consequence is that the set of solutions can always be transformed so as to bring the required magnitude of the phase angle of the differential phase shift parameter arg($\delta$) to $\pi/6$ (i.e., 30°) or less, a significantly smaller value than those of prior theory and practice, which is important for practical device design as well as for circulator theory in general.

The result of the analysis sketched above is in the nature of an "existence proof"; it imposes no limitation and conversely provides no guidance, as to how the phase and reflection characteristics of the components are to be physically realized. Frequency dependence does not appear explicitly, but is implied by the dispersive properties of the components. Ideal absence of dissipation is assumed in the part of the analysis leading to prescriptions for perfect circulation, but the influences of loss can be fully investigated within the formulation.

Figure 11A:
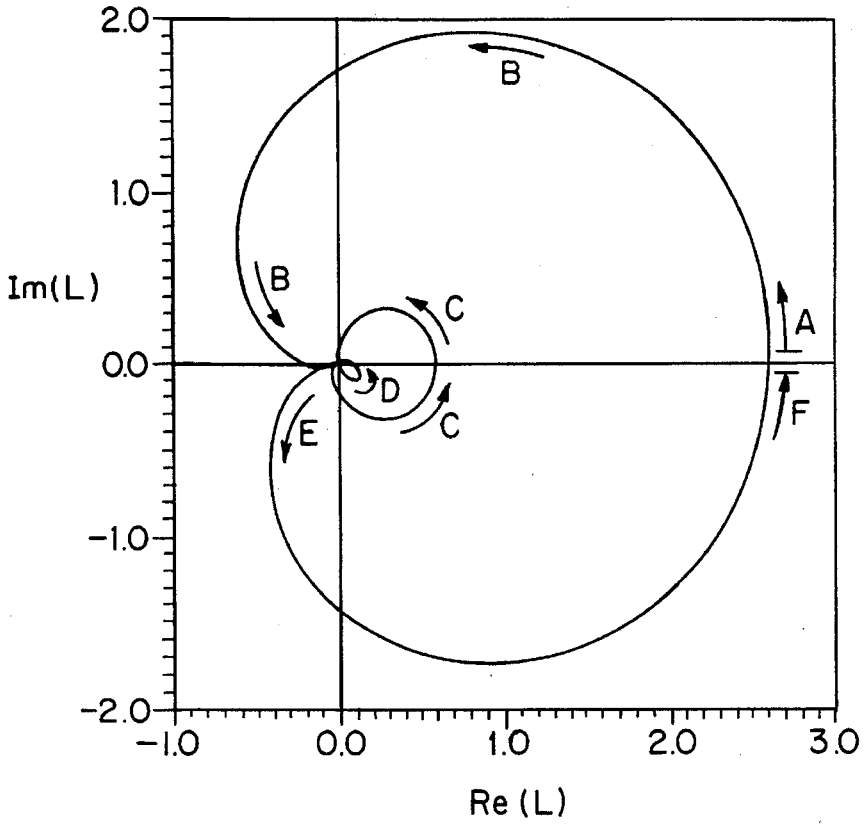
FIG. 11A is a plot of the behavior of $L(\epsilon)$ from Equation 7 as the angle of the average phase shift $\arg(\epsilon)$ ranges from 0° to 180°.
Figure 11B:
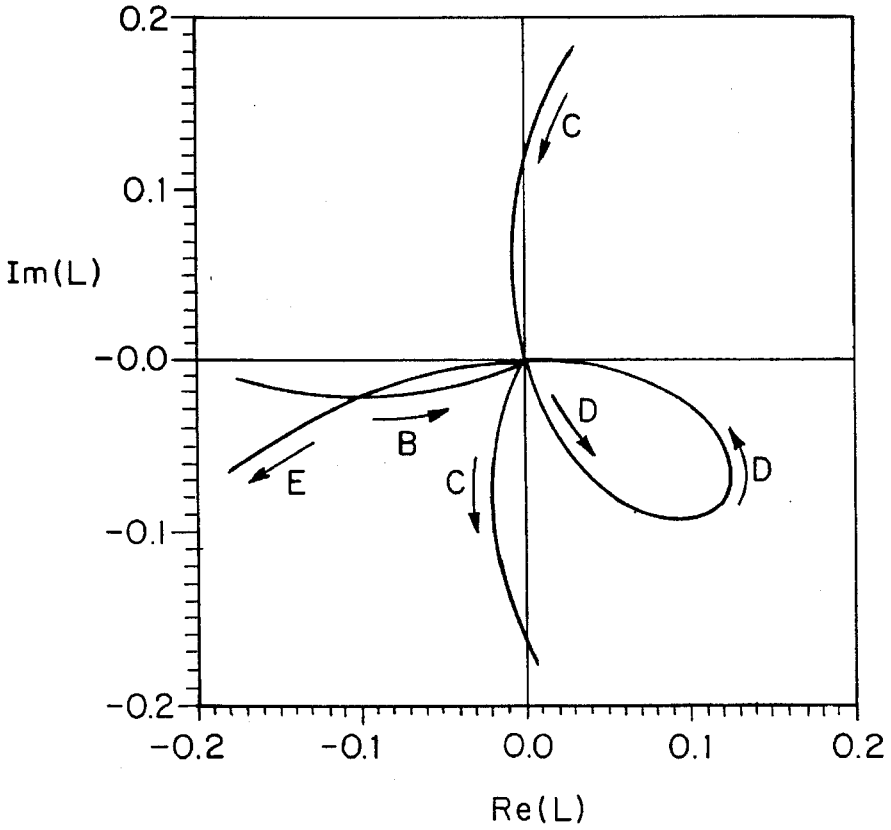
FIG. 11B is a close-up view of the plot of FIG. 11A near the origin.

Referring to the left-hand-side of Equation 7 as L($\epsilon$), solutions of L($\epsilon$)=0 are sought. The behavior of L($\epsilon$) on the complex plane is complicated and sensitive to the values of r and s. A particular case is illustrated in FIG. 11A as arg($\epsilon$) varies from 0° at point A to 180° at point F. Four solutions of the function L($\epsilon$), that is, solutions of Equation 7, namely L($\epsilon$)=0, in the form of zeros, are pictured in FIG. 11B which is an enlarged view of the origin area of FIG. 11A. As arg($\epsilon$) increases from zero along arrow B, L($\epsilon$) goes to zero and reverses direction at arg($\epsilon$)=56.15°. The plot continues in the direction shown by arrow C, undergoes a smaller loop and again crosses zero at arg($\epsilon$)=116.36°. The plot continues in a smaller loop shown by arrow D and L($\epsilon$) crosses zero again at arg($\epsilon$)=135.34°. From here, L($\epsilon$) leaves the origin area in the direction shown by arrow E, and terminates at point F where arg($\epsilon$)=180°. The four solutions are at the origin of the complex plane where L($\epsilon$) =zero; that is, Equation 7 is satisfied for these values of arg($\epsilon$). The four solutions for the mean phase factor $\Delta$ lead to four solutions for the differential phase factor $\delta$. The magnitude and phase angles of the valid solutions $\epsilon$ and $\delta$ are tabulated below in Table 1. Only two of the four solutions are retained as leading to physically meaningful values of the differential phase factor $\delta$ satisfying Equation 10. The first two solutions constitute an unphysical double root for which $\delta$ is indeterminate, and are discarded. The values of r and s, which specify the T-junctions leading to these solutions are defined below in the Table.

TABLE I

| | r = 0.377∠104.87°<br>s = 0.655∠−45.34° | |
|---|---|---|
| Solution | $\epsilon$ | $\delta$ |
| 1,2 | 1.0∠56.15° | —∠— |
| 3 | 1.0∠116.36° | 1.0∠39.93° |
| 4 | 1.0∠135.34° | 1.0∠26.40° |

In this example, Solution 4 calls for a differential phaser angle arg($\delta$) which is less than 30°. Circulation can occur with extremely small values of this parameter. In fact, this model actually imposes no non-zero lower limit on the magnitude of non-reciprocal differential phase. This is an important characteristic of the ring network circulator as it allows for circulators embodying small amounts of gyrotropic matter, suggesting designs with small size and low magnetic loss. It is noted that this result may appear to contradict an accepted general theorem of Carlin:

Carlin, H. J. "On the Physical Realizability of Linear Non-Reciprocal Networks; *Proc. IRE* 48 606–616 (May, 1955).

The theorem is based on a circuit model of a circulator in which non-reciprocity is embodied in a "gyrator", a circuit element characterized by $\phi_+$=180°, $\phi_-$=0° [equivalent to our arg($\epsilon$)=arg($\delta$)=90°]:

Tellegen, B. D. H., "The Gyrator: A New Electric Network Element", *Philips Research Reports* 3 (81) (1948).

It states that the minimum number of gyrators required for circulation is one, which seems to set a lower limit on |arg($\delta$)| of 90/3 =30° for each of the three differential, or non-reciprocal phase shifters $PS_{12}$, $PS_{23}$, $PS_{31}$. The ring network circulator of the present invention is, however, not formulated in terms of gyrator units; there is no incompatibility between its predictions of small values of |arg($\delta$)| and Carlin's circulator theorem.

To model frequency dependence, knowledge of the dispersive properties of the components is required. Success in physical realization of the ring network circulator depends on the designer's skill in making reciprocal T-junctions and non-reciprocal phase shifters which conform to the prescribed values of the scattering coefficients r, s, $r_d$, $s_s$ and non-reciprocal phase factors $\epsilon$ and $\delta$, respectively, and possess favorable dispersive properties. Collections of useful related formulas and data have been presented in the microwave literature, for example:

Wadell, B. C., "Transmission Line Design Handbook", *Artech House,* 1991 (see Sec. 5.5.10–12 and references cited therein).

A specific example of a T-junction and its consequences on the resulting circulator is now considered. The illustration includes a description of how the design of the T-junction with prescribed scattering characteristics can be accomplished, how these parameters are interrelated under the requirements of reciprocity, energy conservation, and geometrical symmetry, and how they in turn determine the values of the non-reciprocal phase shifter parameters $\epsilon$ and $\delta$ required for circulation. With reasonable assumption as to the dispersive properties of the components, the predicted frequency-dependence of circulator performance can be evaluated.

Figure 3B:
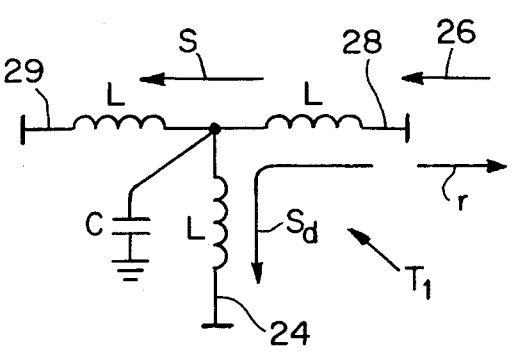
FIGS. 3A and 3B are schematic representations of T-junctions having series inductance and shunt capacitance in accordance with the present invention.
Figure 3A:
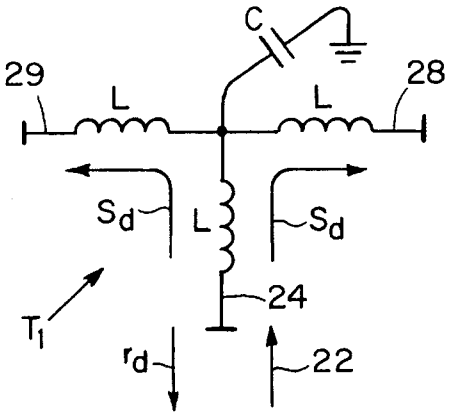

In the present example, we assume the T-junction to be symmetrically loaded by a shunt capacitor and series inductors. The effects can be formulated analytically in the special case of a junction possessing three-fold rotational symmetry (i.e., a Y-junction: $r_d$=r, $s_d$=s) loaded by a shunt capacitor C at the junction and by a series inductor L connected from the junction to each of the three ports. FIGS. 3A and 3B are schematic representations of such a junction also showing the scattering coefficients r, $r_d$, s, $s_d$ as a result of signals 22, 26 incident on the external port 24 and internal ports 28,29 respectively, as described above in conjunction with FIGS. 2A and 2B. The bandwidth properties of this model can be investigated through the frequency-dependencies of capacitive susceptance (ωC) and inductive reactance (ωL), where ω is the radian frequency together with appropriate assumptions about dispersion in the phase shifters.

Figure 4B:
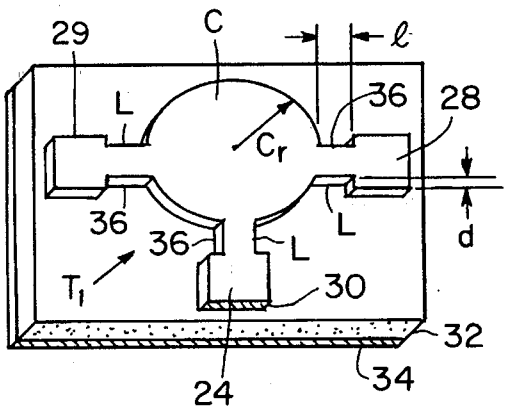
FIGS. 4A and 4B are perspective views of stripline T-junctions exemplifying how the magnitudes of the shunt capacitance and series inductances of the junctions can be controlled in accordance with the present invention.
Figure 4A:
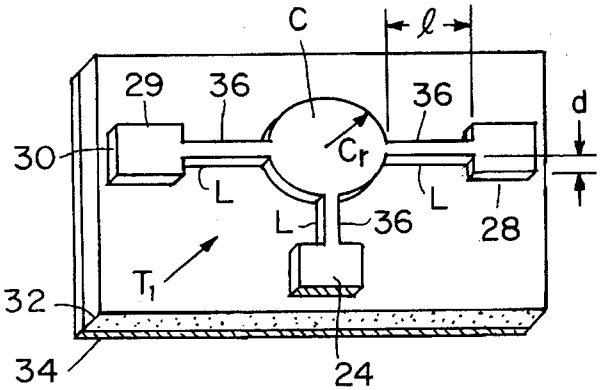

FIGS. 4A and 4B are perspective views of an embodiment of the T-junction shown in FIG. 3A. The junction $T_1$ comprises a microstrip 30 of standard conducting or superconducting material, formed on an insulator 32. A ground plane 34 is formed on the insulator 32 face opposite that of the strip 30. A shunt capacitor C is formed in the T-junction $T_1$ by widening the area of the intersection of the external port 24 and internal ports 28,29. The region between the two parallel capacitive areas is filled with insulation 32, thus forming a capacitor C for storage of electric energy. The capacitance is defined by the area of the plate (i.e. the radius $C_r$) and by the dielectric constant and thickness of the insulation 32. Series inductors L are formed between each port 24,28,29 and the capacitor C by forming notches 36 in the stripline, thus narrowing the strip in a controlled fashion over a predetermined length l and depth d. This introduces inductance L, or the capacity to store magnetic energy in each leg of the junction.

The magnitude of the shunt capacitance C and series inductance L can be controlled by adjusting the radius $C_r$ of the capacitive area C and by adjusting the length 1 and depth d of the notches 36. In FIG. 4B, the radius $C_r$ of the capacitive area is increased, as would be the area formed in the ground plane 34, thus, increasing the shunt capacitance C of the junction $T_1$. The series inductance L of the ports is decreased by decreasing the length 1 and depth d of the grooves 36. In this manner, the magnitude of the shunt capacitance C and series inductance L is controlled. The foregoing microstrip design is only intended as in illustration, the same design concept can also be realized in a corresponding manner with balanced stripline, enclosed waveguide, or other transmission-line media.

Figure 5A:
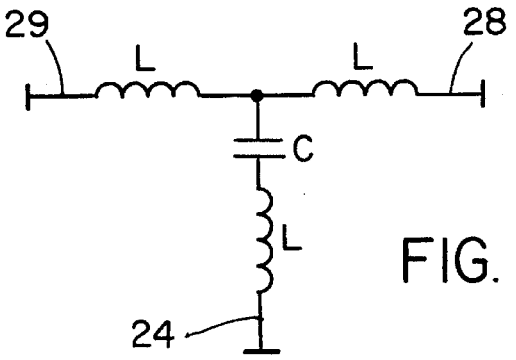
FIG. 5A is a schematic representation of a T-junction having series inductance at each port and series capacitance between the external port and internal ports in accordance with the present invention.
Figure 5B:
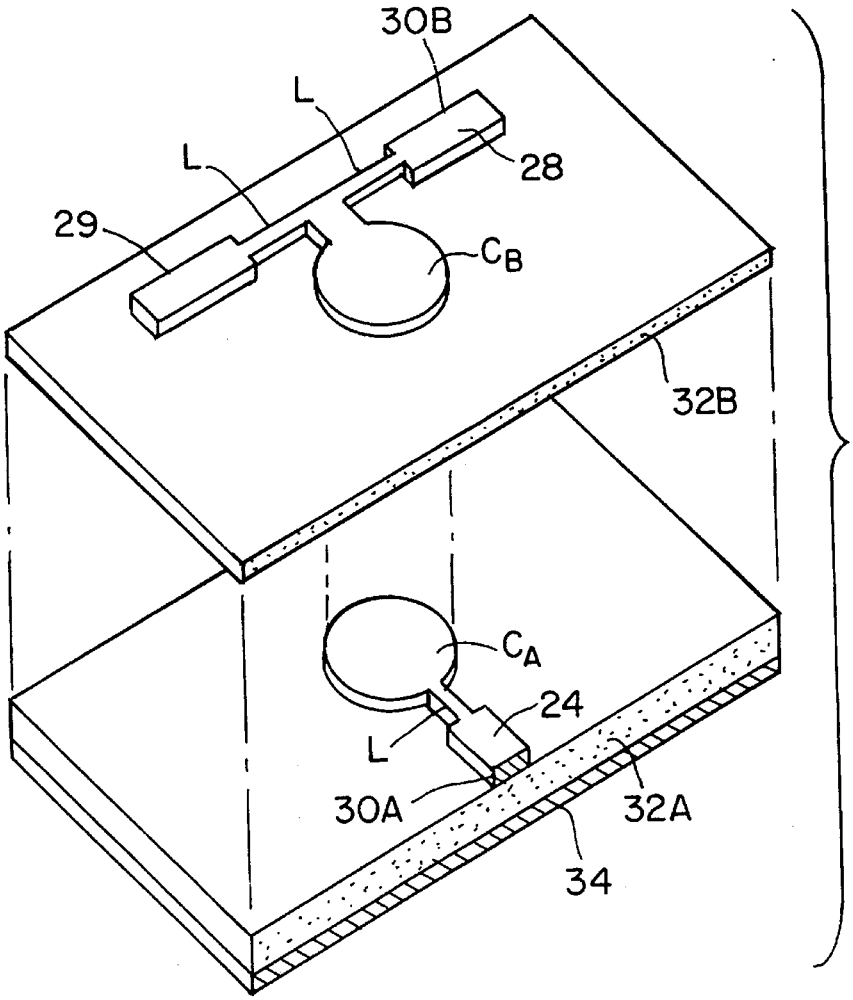
FIG. 5B is an exploded perspective view of a stripline T-junction formed in accordance with the schematic of FIG. 5A.

FIG. 5A is a schematic representation of an alternative T-junction having series inductances L and a series capacitance C between the external port 24 and the internal ports 28,29. FIG. 5B is an exploded perspective view of a T-junction corresponding with the schematic of FIG. 5A. A first conductive strip 30A is formed over a first insulator 32A and a ground plane 34. A capacitive area $C_A$ and inductive notch L are formed, along with a strip 24 for the external port. A second strip 30B is formed over a second insulative layer 32B. The second strip 30B includes internal ports 28,29 each with a series inductive notch L connected to a capacitive area $C_B$ as shown. The layers are bonded together such that the capacitive areas $C_A$, $C_B$ align on opposite faces of the insulative layer 32*b*, thus forming a capacitor $C_A$, $C_B$ in series with the external port 24. The magnitudes of the capacitance C and inductance L are controllable as described above.

The simplifying assumption of Y-symmetry leads to some interesting and useful conditions of the scattering coefficients. In Equation 3 for r, s in terms of the four real parameters (the degeneracy parameter γ and the phase angles of the eigenvalues of the scattering matrix $\delta_{a,b,c}$), setting $r_d$=r and $s_d$=s leads to tan2γ=2√2, hence:

$$\begin{aligned}&\text{either}\\&\gamma = 35.26^\circ \text{ with } s_a = s_c\\&\text{or}\\&\gamma = -54.74^\circ \text{ with } s_a = s_b\end{aligned} \tag{11}$$

It is also useful to note that the expressions for r and s imply:

$$r-s=s_\alpha;\ \text{thus } |r-s|=1 \tag{12}$$

which holds in the more general case of T-symmetry.

In the special case of Y-symmetry, unitarity of the scattering matrix S (a manifestation of energy conservation, namely S†S=I, where † denotes the Hermitean adjoint and I is the unit matrix) leads to $$|r|^2 + 2|s|^2 = 1 \tag{13}$$

and $$\cos(\rho - \sigma) = -\frac{|s|}{2|r|}$$

where ρ, σ are respectively the phase angles of r and s.

Assume the notation $\omega C Z_0=\eta$ and $\omega L Y_0=\zeta$, where ω is the radian frequency and $Z_0=1/Y_0$ is the characteristic impedance of the lines connected to the three ports. Note that the implied assumption that the transmission lines connected to the three ports have equal characteristic impedance is not required nor necessarily advantageous; it is only adopted here in order to simplify the illustrative presentation. Straightforward analysis of voltage and current relations at the input and output ports of the Y junction of FIGS. 3A and 3B leads to the following expressions for r and s:

$$r = \frac{-1 + j[-\eta + \zeta(3 - n\zeta)]}{3 - 2\eta\zeta + j[\eta + \zeta(3 - \eta\zeta)]} \tag{14}$$

$$s = \frac{2}{3 - 2\eta\zeta + j[\eta + \zeta(3 - \eta\zeta)]}\ .$$

When not loaded, η=ζ=0 the Y-junction is characterized by the real values r=−1/3, s=2/3. With increases in loading these parameters ultimately become totally reflective: (r=−1, s=0 for capacitive loading and r=+1, s=0 for inductive loading). When both capacitive and inductive loading are incorporated, performance of the Y-junction is complicated, as expected.

Figure 12:
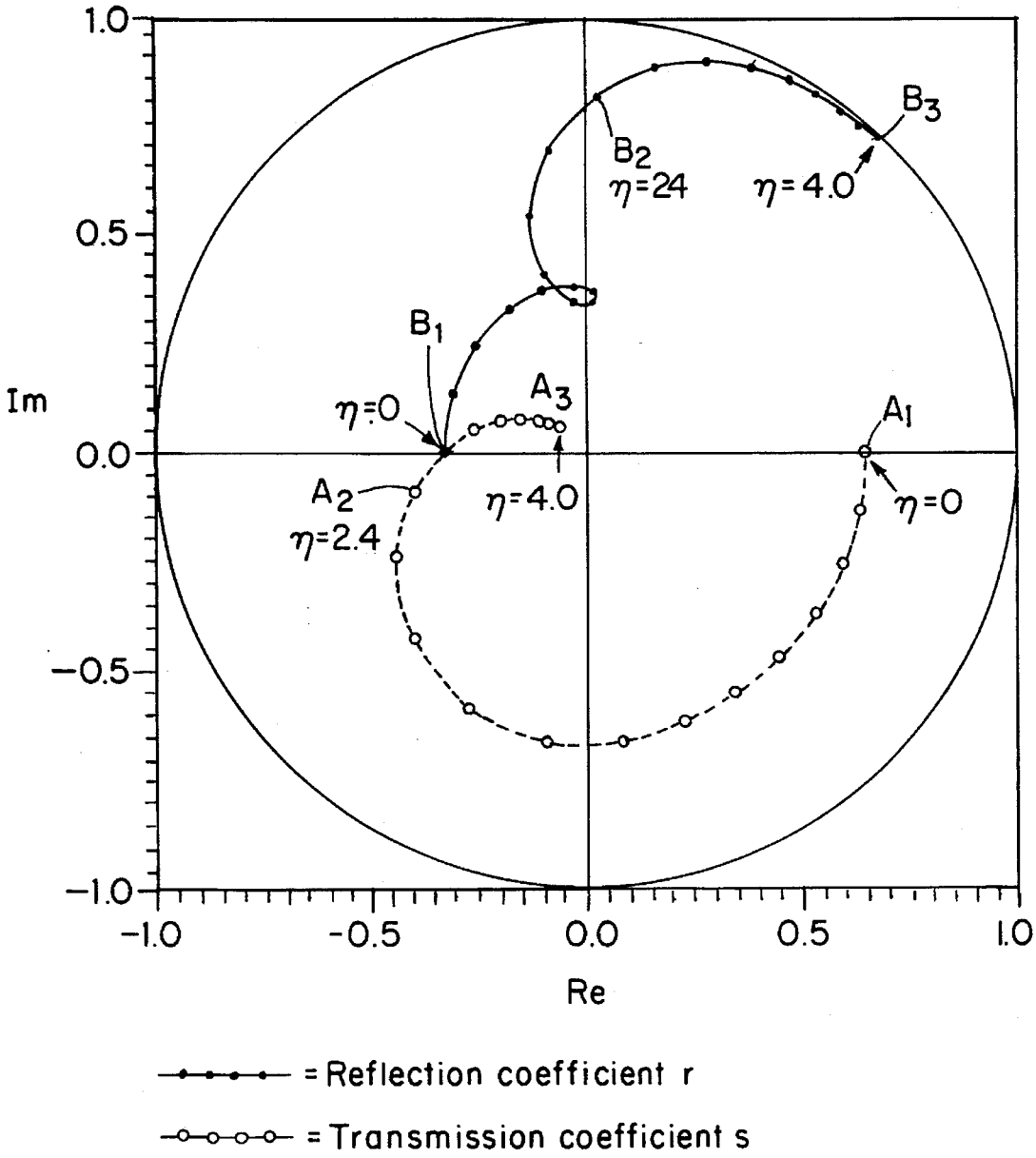
FIG. 12 is a plot of the behavior of the scattering coefficients r and s of a Y-junction as the susceptance parameter $\eta$ of the junction varies from 0 to 4 in accordance with a typical embodiment the present invention.

An example in which the ratio ζ/η is assigned the ratio value 2/3 for inductive and capacitive loading, and with η varying from 0.0 to 4.0, is shown in FIG. 12. The behavior of the reflection coefficient r and the transmission coefficient s as functions of the susceptance parameter η and the reactance parameter ζ permits an interesting view of the influence of η and ζ on the ring network circulator characteristics. At points $A_1$ and $B_1$, the parameters η and ζ are 0, and at these points, s equals 2/3 and r equals −1/3. At points $A_3$ and $B_3$, η is 4.0 and ζ is 8/3. With further increase in loading, it is apparent that r converges on 1 and s converges on 0.

Figure 13:
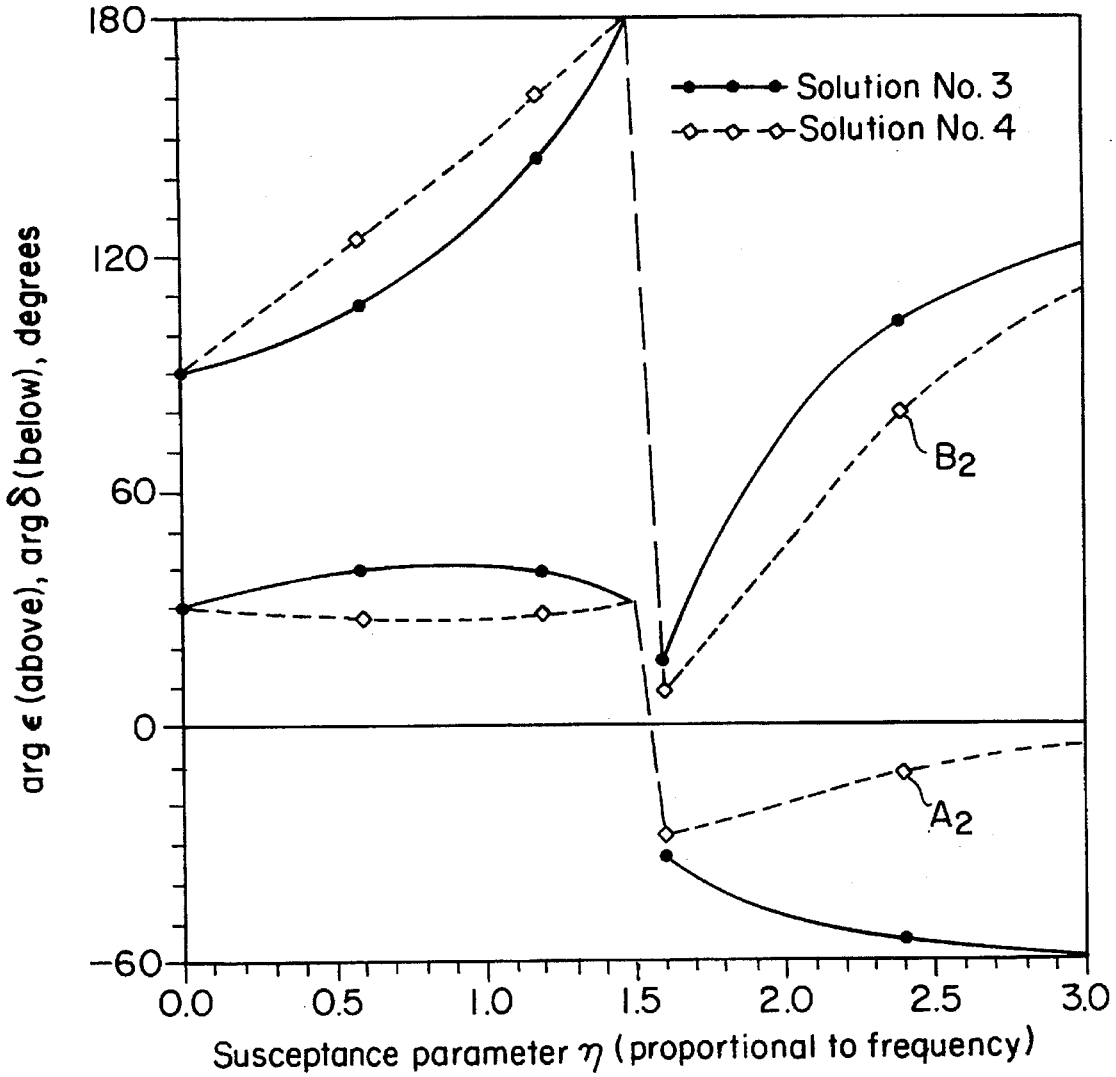
FIG. 13 is a plot of average phase angle $\arg(\epsilon)$ and differential phase angle $\arg(\delta)$ as the susceptance parameter $\eta$ varies from 0 to 3 in accordance with a typical embodiment of the present invention.

The courses of arg(ε) and arg(δ), where arg denotes the phase angle, or argument of a complex number for the two acceptable solutions (Solutions 3 and 4) of Equations 7 and 9 which satisfy the conditions of Equations 10, as functions of η, with ζ/η=2/3, are shown in FIG. 13. The interval 1.8<η<3.0 best exemplifies the capability for circulation with small amounts of differential phase, and therefore, smaller amounts of gyrotropic medium and also provides for small amount of mean phrase arg(ε) providing advantages in miniaturization. For solution 4 (from Table 1)over this range of susceptance parameter $\eta$, arg($\delta$) varies from −25.1° to −6.1° and arg($\epsilon$) varies from 25.2° to 104.40°. Each set of corresponding values for arg($\delta$) and arg($\epsilon$) defines symmetrical phase shifters of average phase factor $\epsilon$ and differential phase factor $\delta$ which yield ideal circulation: zero insertion loss, high isolation, and low return loss over the frequency band.

Figure 15:
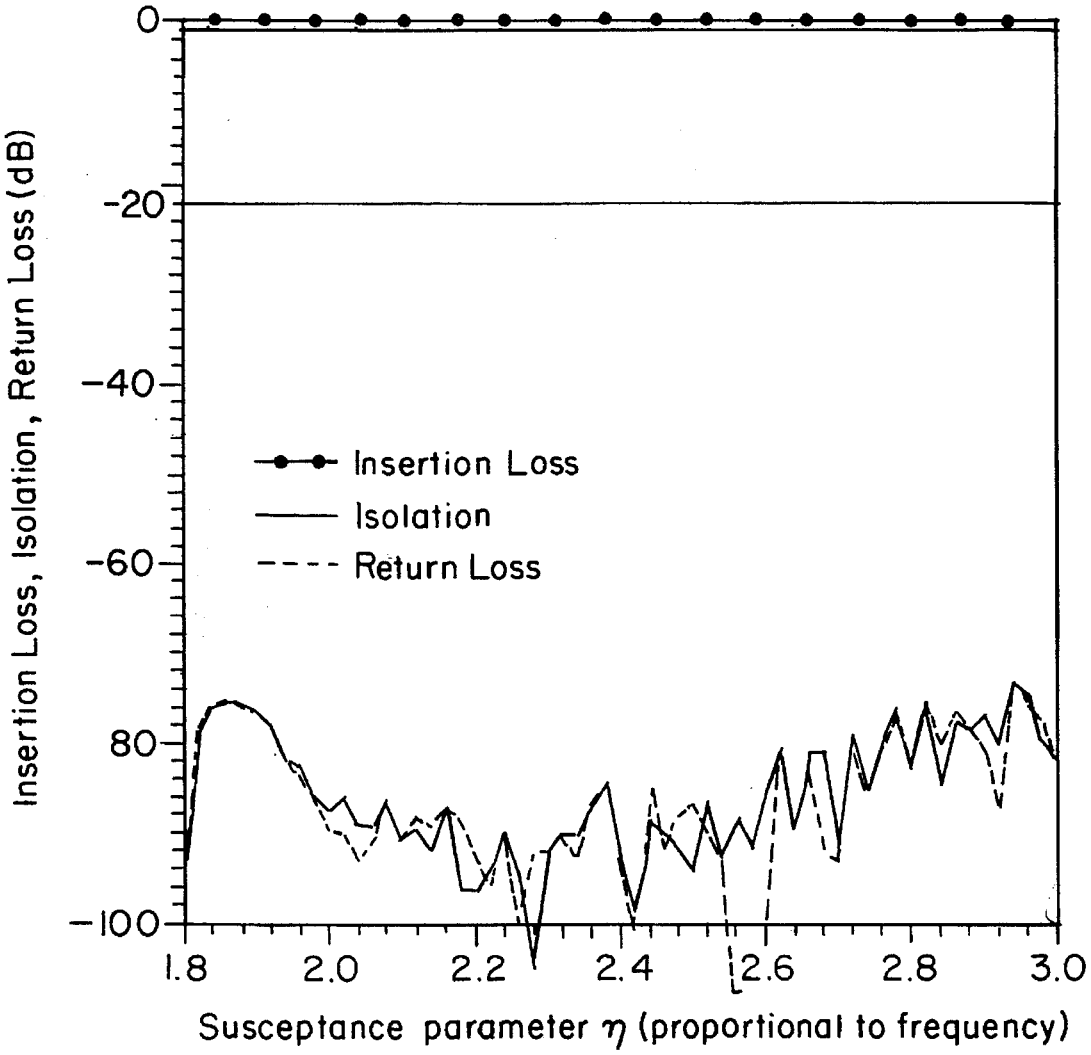
FIG. 15 is a plot of the circulator frequency response if the phase shifters are designed to perfectly match $\arg(\delta)$ and $\arg(\epsilon)$ in the frequency band of interest.

If phase shifters are designed to accurately correspond with the chart of FIG. 13, there is no theoretical limit on the bandwidth of the device. FIG. 15 is a plot of the circulator characteristics realizable if a perfect correspondence is obtained. As can be seen, insertion loss is negligible far less than the marker at 1 dB. Also isolation and return loss are highly favorable throughout the entire band of interest. In reality, however, it is very difficult to design phase shifters which conform with the curves of FIG. 13 over the entire range of interest. For this reason, the phase shifters may be designed in accordance with approximations of the courses of arg($\epsilon$) and arg($\delta$).

Figure 14:
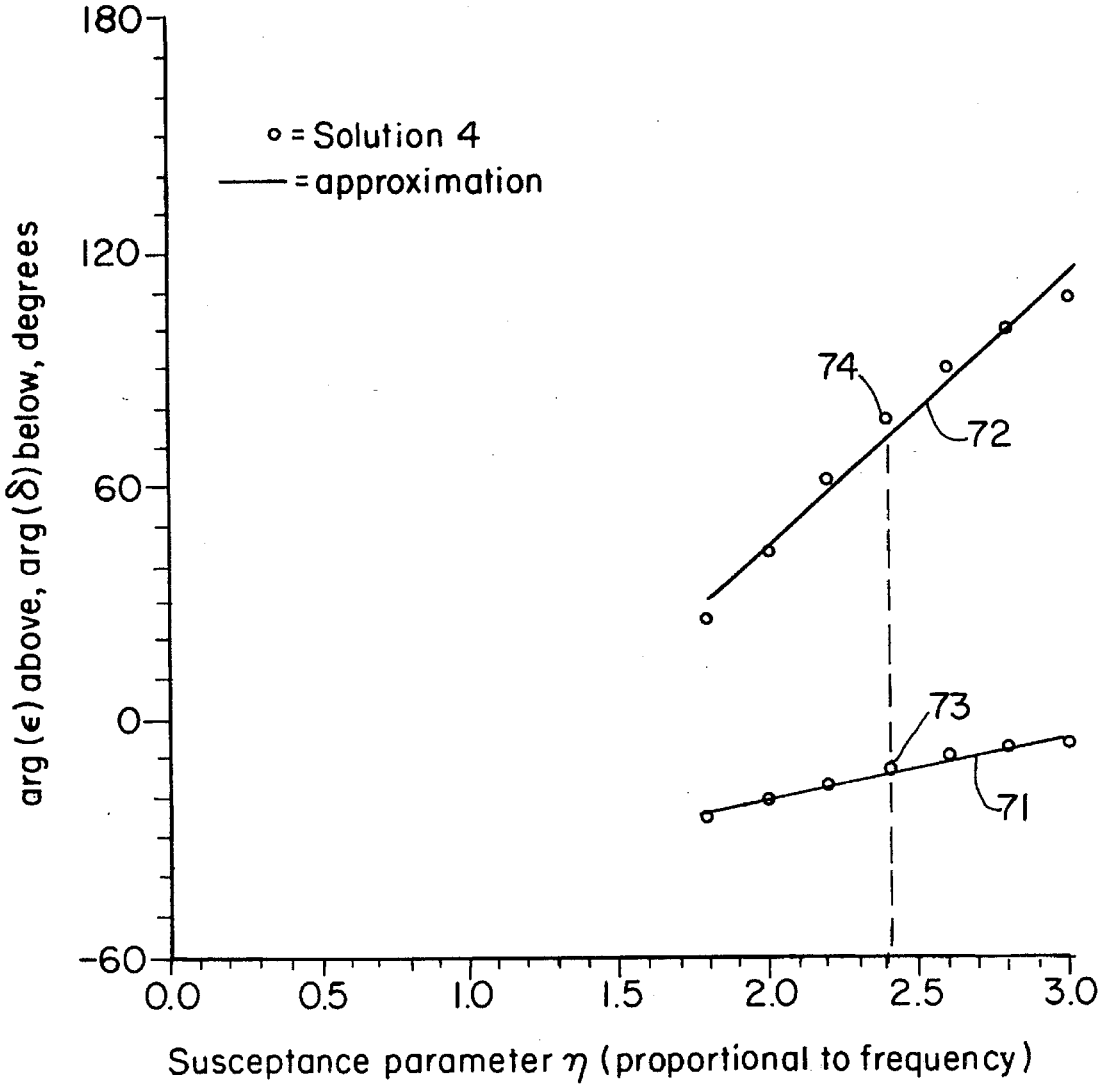
FIG. 14 is a plot of Solution 4 in the region of interest: $1.8<\eta<3.0$, and linear approximations thereof.
Figure 16:
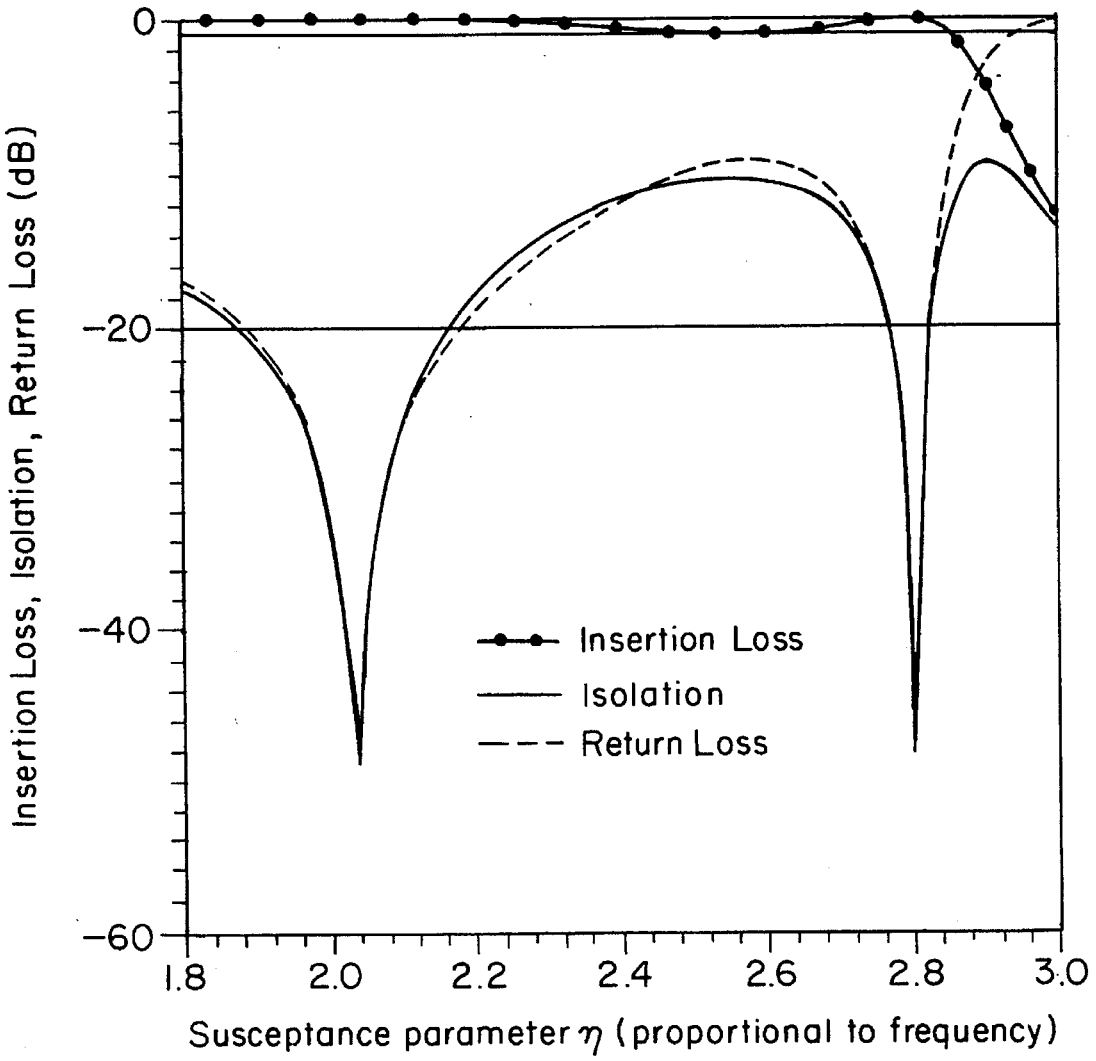
FIGS. 16–18 are plots of the circulator frequency response for phase shifters designed in accordance with various linear approximations of $\arg(\delta)$ and $\arg(\epsilon)$.

FIG. 14 is plot similar to that of FIG. 13, focusing on the values of arg($\epsilon$) and arg($\delta$) in the range of interest of the susceptance parameter $\eta$ for Solution 4 of Table 1. Lines 71 and 72 represent "least squares" linear approximations of arg($\delta$) and arg($\epsilon$) respectively over the range of interest ($1.8<\eta<3.0$). The results of this initial approximation are shown in FIG. 16. It can be seen in FIG. 16 that although this approximation leads to favorable insertion loss over the band of interest (less than 1 dB), the isolation and return loss characteristics are reduced in parts of the band and may be inappropriate for certain applications.

Figure 17:
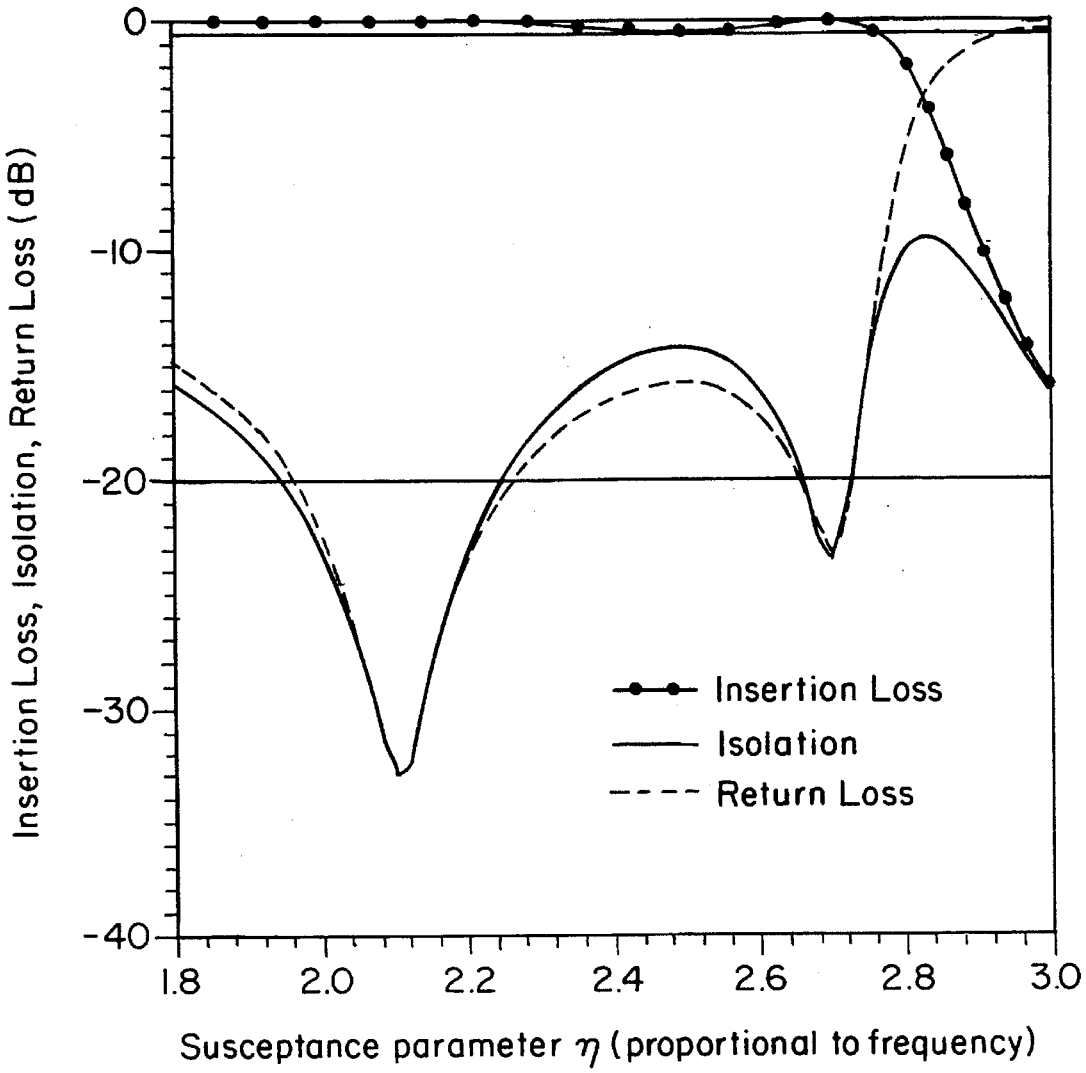

FIG. 17 is a plot of the circulator characteristics resulting from adjusting the linear approximations 71, 72 to be slightly closer to their respective center points, 73,74 of interest at $\eta$=2.4. This again results in favorable insertion loss throughout most of the band, and a noted improvement in isolation and return loss.

Figure 18:
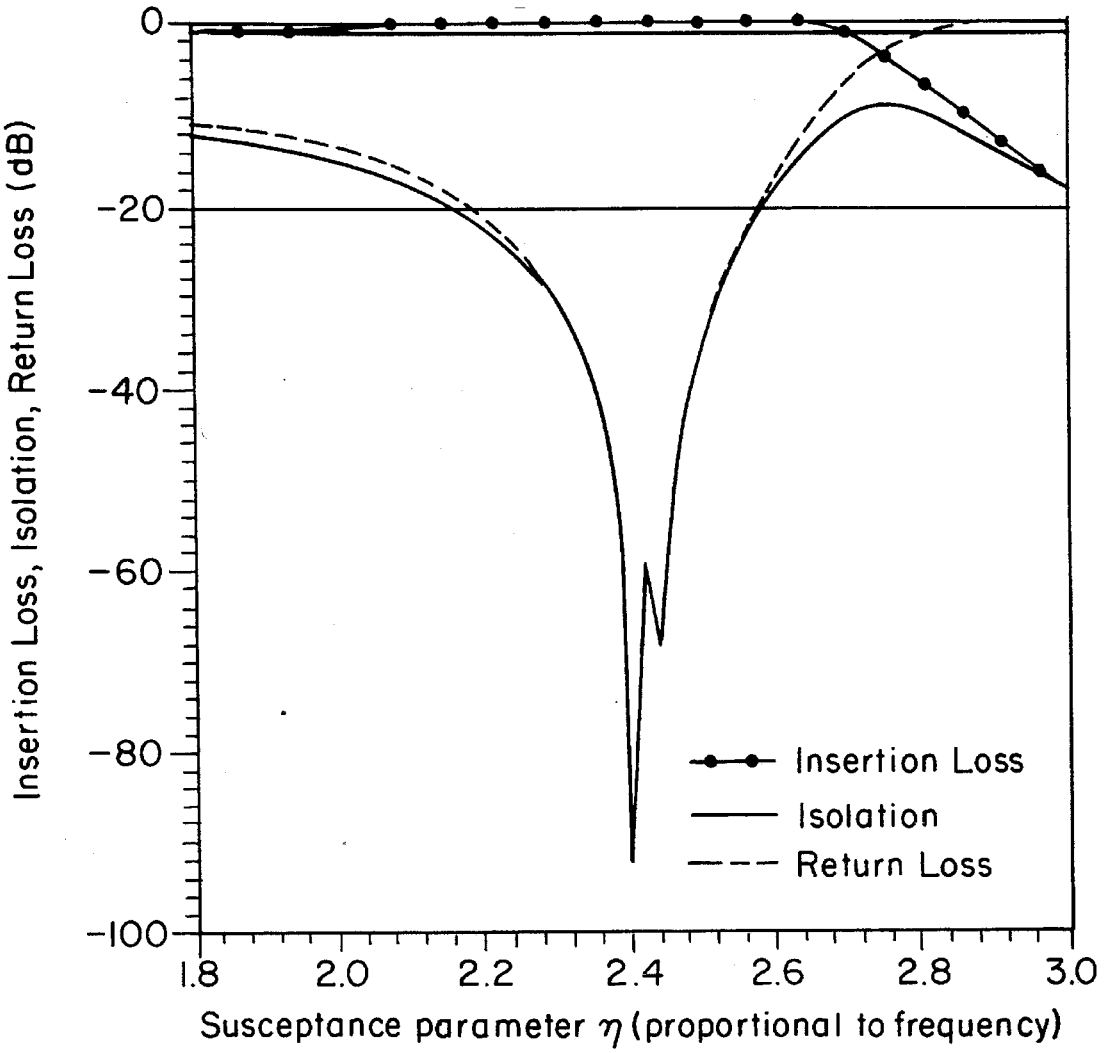

The characteristics of FIG. 18 result from moving the linear approximation lines 71,72 even closer to the respective center points of interest 73,74. Favorable (negligible) insertion loss is apparent throughout the band, and isolation and return loss are quite favorable about the band center at $\eta$=2.4. However, the bandwidth of operation (isolation and return loss less than −20 dB) is narrowed to approximately ±8% about the band center.

Figure 19:
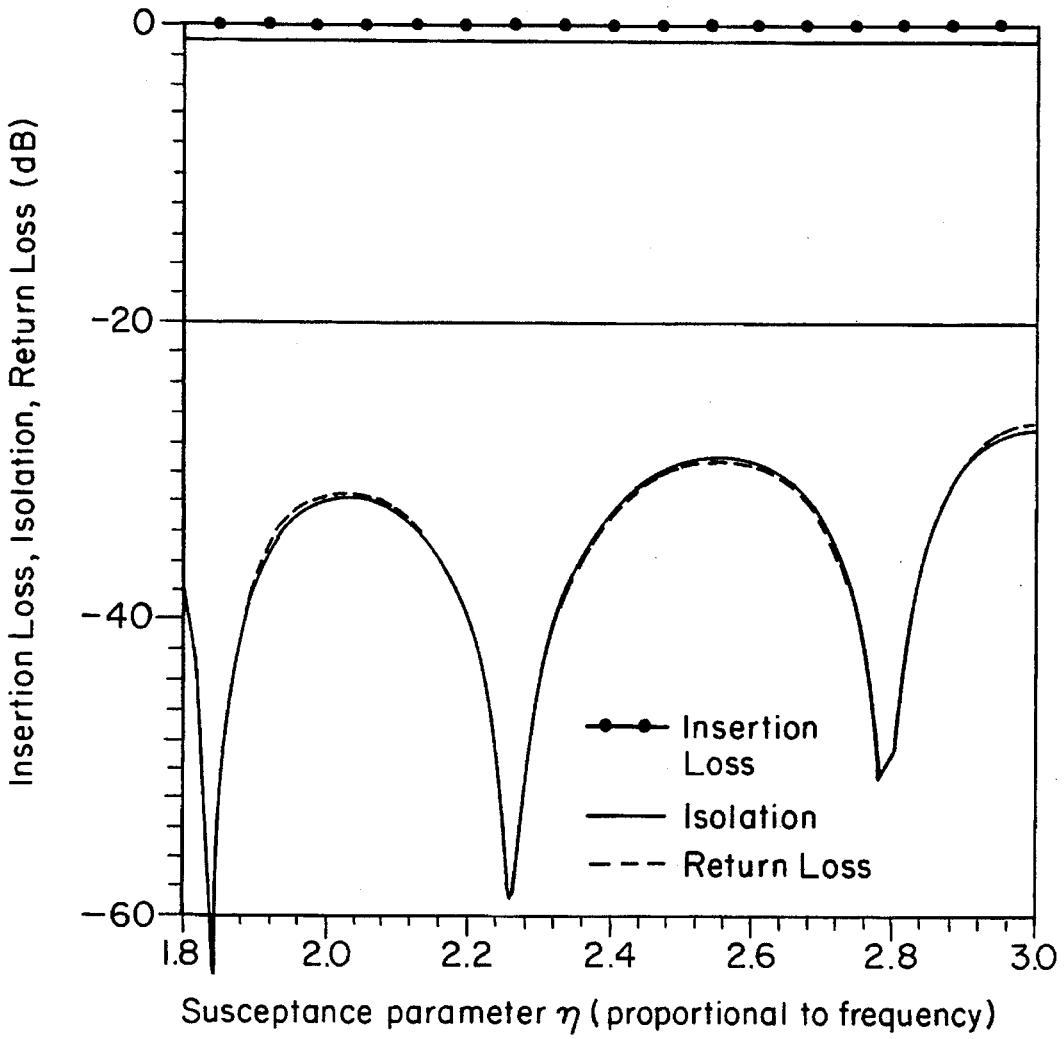
FIG. 19 is a plot of the circulator frequency response if the phase shifters are designed in accordance with a quadratic approximation of $\arg(\delta)$ and $\arg(\epsilon)$.

In addition to the linear approximations described above, other approximations may be used, wherever appropriate to more accurately follow the behavior of arg($\epsilon$) and arg($\delta$) in the range of interest. For example, a quadratic approximation gives the circulator characteristics shown in FIG. 19. Extremely favorable insertion loss is apparent throughout the entire band of interest. In addition, the isolation and return loss are also favorable throughout the band. This leads to bandwidth of at least ±25% about the band center. This exemplifies what is meant by "unlimited bandwidth". If the differential phase shifters are designed to follow the courses of arg($\epsilon$) and arg($\delta$) perfectly, there is no theoretical limit to the bandwidth of favorable circulation.

Since the capacitive susceptance parameter $\eta$ and the inductive reactance parameter $\zeta$ are proportional to frequency, this performance is comparable to the type of frequency-dependence characterizations to which circulator designers are accustomed. As a specific illustrative example, consider a microwave system based on transmission lines of characteristic impedance $Z_0$ equal to 50 ohms, with band center at 10 GHz. In order to satisfy the conditions for circulation centered at $\eta$=2.4 and $\zeta$=(2/3)$\eta$=1.6, using shunt capacitance C and series inductors L as in FIG. 3, capacitance L inductance values of C=0.764 pF and L=1.273 nH respectively, would be required. These are achievable with well-known design methods, such as designs of the type exemplified in FIG. 4. The associated parameters resulting in circulation centered at 10 GHz would be:

$\eta = 2.4,\ \zeta = 1.6$
$r = 0.808\angle 87.76°$
$s = 0.417\angle -167.28°$
(points $A_2$ and $B_2$ in FIG. 11)

$\epsilon = 1.0\angle 77.27°$
$\delta = 1.0\angle -12.70°$
(points $A_2$ and $B_2$ in FIG. 12)

If components meeting these specifications at 10 GHz are utilized, and if they continue to conform at higher and lower frequencies (down to 7.5 GHz and up to 12.5 GHz in this illustration), with a good approximation, the specified dependencies of r, s, $\epsilon$, and $\delta$ on $\eta$ and $\zeta$ (from $\eta$=1.8, $\zeta$=1.2 to $\eta$=3.0, $\zeta$=2.0 in this illustration) then the device will circulate over the entire band (±25%, a very broad bandwidth in comparison with present circulator practice). Thus, in this example, the "bandwidth" is unlimited. The only limits are those of our arbitrary choice of range of attention: about ±25% in this example. Such an ideal is achievable, or approachable, if the dissipative losses of the T-junctions and phase shifters are reasonably low and if their dispersive characteristics conform reasonably well to the phase and amplitude relations prescribed by the theory.

The model is capable of yielding much better performance, approaching the ideal cited above, when optimized for a particular combination of bandwidth, circuit style and size, T-junction and differential phase shift design, and other specifications. It is important to note, that in the prior art, circulators are designed as a complete entity, with reduction of internal refections as a goal for designers. In contrast, the circulator of the present invention considers the characteristics of the individual junctions and intentionally creates internal reflections at the junctions so that in the assembled ring network, the reflections cancel at the input and isolated ports and reinforce each other at the transmission port.

To complete the present illustration, we note that differential phase shifter designs which have been investigated up to the present are ferrite-loaded stripline comb-line filters, and ferrite-substrate microstrip meanderlines. Other nonreciprocal phase shifter designs have been studied or developed for various microwave system applications. Future invention and development of this general class of devices will be associated with specific system requirements and will be applicable to embodiments of the ring-network circulator.

The invention is applicable to all circulator technologies and is not limited to the microstrip embodiments shown. External magnets are not required, but may be used for magnetizing the ferrite. The invention is adaptable to high-power applications. While in conventional Bosma-type circulators the resonator must be of a certain size related to the wavelength, the invention has no intrinsic size requirements and therefore is amenable to miniaturization, with lower ferrite requirements.

For the present era of thin-substrate integrated microcircuit technology, it is generally acknowledged that the conventional resonant-type circulator tends to suffer from inconvenient size, weight, and complexity. The ring-network circulator concept disclosed herein opens up an extensive range of design parameters and freedom from those vexing limitations, new solutions to a number of specialized requirements, and a rigorous basis for design, prediction, and interpretation.

While this invention has been particularly shown and described with references to preferred embodiments thereof, it will be understood by those skilled in the art that various changes in form and details may be made therein without departing from the spirit and scope of the invention as defined by the appended claims.

We claim:

1. An electromagnetic circulator comprising:

a plurality of junctions; each junction having an external port for transmitting and receiving electromagnetic signals;

predetermined inductive reactance means and capacitive susceptance means formed in each junction to cause each individual junction to partially reflect incident signals in a predetermined frequency-dependent manner;

a like plurality of non-reciprocal phase shifters electrically interconnecting the junctions; and average phase shift means and differential phase shift means formed in each phase shifter providing each phase shifter with a frequency-dependent average phase shift and differential phase shift respectively which are correlated with the frequency-dependent characteristics of the reactance and susceptance of the junctions over a band of frequencies such that the interconnected junctions and phase shifters form a circulator which produces circulation of signals of frequencies within the band incident on an external port, the reflected signals at the junctions substantially reinforcing each other at an adjacent external transmitting port and substantially cancelling each other in the remainder of the junctions.

2. The electromagnetic circulator of claim 1 wherein the non-reciprocal phase shifters comprise delay lines for electrically interconnecting the junctions and a magnetic structure proximal to the delay lines having a magnetization which interacts with the magnetic field of the electromagnetic signals traversing the delay lines, inducing phase shift in the signal, the phase shift being dependent on the direction of propagation of the signals, such that the phase shift is non-reciprocal.

3. The electromagnetic circulator of claim 2 wherein the delay lines comprise meanderlines.

4. The electromagnetic circulators of claim 3 wherein the meanderlines are oriented tangentially about the ring network.

5. The electromagnetic circulator of claim 2 wherein the delay lines comprise comb filters.

6. The electromagnetic circulator of claim 2 wherein the junctions and delay lines are formed of superconductors operating in a superconducting state, and the magnetic flux is substantially confined within the structure so that the flux does not substantially permeate the superconductor.

7. The electromagnetic circulator of claim 6 wherein the magnetic structure is formed in the shape of a thin, self-biased disk having a magnetization directed normal to the surface of the disk.

8. The electromagnetic circulator of claim 6 wherein the magnetic structure is formed in the shape of a toroid.

9. The electromagnetic circulator of claim 8 wherein the toroidal magnetic structure includes a control wire disposed through a hole in the toroid for conducting current which induces a tangential magnetization in the structure; the direction and strength of the magnetization being a function of the direction and strength of the current conducted by the control wire.

10. The electromagnetic circulator of claim 9 wherein the magnetization in the magnetic structure is remanent after current is removed from the control wire.

11. The electromagnetic circulator of claim 1 wherein the junctions are formed with inductive reactance means and capacitive susceptance means of values which minimize the differential phase shift means required in the correlated phase shifters for circulation to occur.

12. The electromagnetic circulator of claim 1 wherein the junctions are T-junctions.

13. The electromagnetic circulator of claim 1 wherein the junctions are Y-junctions.

14. The electromagnetic circulator of claim 1 wherein each junction is symmetrically loaded by a shunt capacitor and series inductors.

15. The electromagnetic circulator of claim 1 wherein each junction includes two electrically symmetrical internal ports and an external port and where each junction is characterized by a matrix $S_T$ of scattering coefficients r,s,$r_d$, $s_d$:

$$S_T = \begin{pmatrix} r & s & s_d \\ s & r & s_d \\ s_d & s_d & r_d \end{pmatrix}$$

wherein:

$$r = \frac{1}{2}\,(s_a + s_b\cos^2\gamma + s_c\sin^2\gamma)$$

$$s = \frac{1}{2}\,(-s_a + s_b\cos^2\gamma + s_c\sin^2\gamma)$$

$$r_d = s_b\sin^2\gamma + s_c\cos^2\gamma$$

$$s_d = \frac{1}{\sqrt{2}}\,(s_b - s_c)\cos\gamma\sin\gamma$$

and wherein $s_a$, $s_b$, and $s_c$ are the eigenvalues of unit magnitude for the matrix $S_T$, and $\gamma$ is the degeneracy parameter which results from the symmetry of the internal ports;

said coefficient r being the proportional part of a signal incident upon one of the symmetrical internal ports which flows from the same symmetrical internal port, said coefficient $r_d$ being the proportional part of a signal incident upon one of the external ports which flows from the same external port, said coefficient s being the proportional part of a signal incident upon one of said symmetrical internal ports which flows from the opposite symmetrical internal port, and said coefficient $s_d$ being the proportional part of a signal incident upon one of the symmetrical internal ports which flows from the adjacent external port.

16. The electromagnetic circulator of claim 15 wherein the ideal average phase factor $\epsilon$ required by the non-reciprocal phase shifters for substantially ideal circulation is chosen from the set of solutions $\epsilon$ to the condition:

$$A_8\epsilon^8+A_6\epsilon^6+A_4\epsilon^4+A_2\epsilon^2+A_0=0,$$

wherein:

$$A_8=A_0^*=a_4a_0.$$

$$A_6=A_2^*=a_4a_2^*+a_2a_0^*-a_3a_1^*$$

$$A_4=|a_4|^2+|a_2|^2+|a_0|^2-|a_3|^2-|a_1|^2$$

and:

$$a_4=(r-s)^3(r+s)$$

$a_3=-s(r-s)^2$ $a_2=-2r(r-s)$ $a_1=s$ $a_0=1.$ and r and s are two of the four reflection and transmission coefficients of the junctions.

17. The electromagnetic circulator of claim 16 wherein the ideal differential phase factor δ required by the non-reciprocal phase shifters to produce substantially ideal circulation is chosen from the set of solutions to the condition:

$$\delta^3=\frac{a_4\epsilon^4+a_2\epsilon^2+a_0}{a_3\epsilon^3+a_1\epsilon}.$$

18. The electromagnetic circulator of claim 15 wherein the junctions are Y-junctions and the capacitive susceptance ωC and inductive reactance ωL of the junctions are related to the reflection coefficient r and transmission coefficient s according to the conditions:

$$r=\frac{-1+j[-\eta+\zeta(3-n\zeta)]}{3-2\eta\zeta+j[\eta+\zeta(3-\eta\zeta)]}$$

$$s=\frac{2}{3-2\eta\zeta+j[\eta+\zeta(3-\eta\zeta)]}$$

where η is the capacitive susceptance parameter, $\eta=\omega CZ_o$; ζ is the inductive reactance parameter, $\zeta=\omega L/Z_0$; $Z_0$ is the characteristic impedance of the external ports; $j=\sqrt{-1}$; and ω is the radian frequency of the incident microwave signal.

19. A method for forming an electromagnetic device comprising the steps of:

forming a plurality of junctions, each junction having an external port for transmitting and receiving electromagnetic signals;

introducing predetermined frequency-dependent inductive reactance and capacitive susceptance into each junction so that each junction partially reflects incident signals in a predetermined frequency-dependent manner;

interconnecting the junctions with non-reciprocal phase shifters, each phase shifter having a frequency-dependent average phase factor ε and differential phase factor δ; and correlating the frequency-dependent average and differential phase factors of the phase shifters with the frequency-dependent characteristics of the reactance and susceptance of the junctions over a band of frequencies such that the interconnected junctions and phase shifters form a circulator which produces circulation of signals of frequencies within the band incident on an external port, the reflected signals at the junctions substantially reinforcing each other at an adjacent external transmitting port and substantially cancelling each other in the remainder of the junctions.

20. The method of claim 19 further comprising the step of forming the non-reciprocal phase shifters with delay lines and a magnetic structure proximal to the delay lines having a magnetization which interacts with the magnetic field of the electromagnetic signals traversing the delay lines, inducing phase shift in the signals, the phase shift being dependent on the direction of propagation of the signals, such that the phase shift is non-reciprocal.

21. The method of claim 19 further comprising the step of forming the delay lines with meanderlines.

22. The method of claim 21 further comprising the step of orienting the meanderlines tangentially about a ring network formed by the interconnected junctions and phase shifters.

23. The method of claim 21 further comprising the step of forming the delay lines with comb filters.

24. The method of claim 20 further comprising the steps of:

forming the junctions and delay lines with superconductors operating in a superconducting state; and forming the magnetic structure to have a confined magnetic flux so that the flux does not substantially permeate the superconductor.

25. The method of claim 24 further comprising the step of forming the magnetic structure in the shape of a thin, self-biased disk having a magnetization directed normal to the surface of the disk.

26. The method of claim 24 further comprising the step of forming the magnetic structure in the shape of a toroid.

27. The method of claim 26 further comprising the steps of disposing a control wire through a hole in the toroid for conducting current which induces a tangential magnetization in the structure; the direction and strength of the magnetization being a function of the direction and strength of the current conducted by the control wire.

28. The method of claim 27 wherein the magnetization in the magnetic structure is remanent after current is removed from the control wire such that the control wire operates as a latching wire.

29. The method of claim 19 further comprising the step of selecting the inductive reactance and capacitive susceptance of each junction to minimize the differential phase shift required between junctions to produce circulation within the band.

30. The method of claim 19 further comprising the step of forming the junctions as T-junctions.

31. The method of claim 19 further comprising the step of forming the junctions as Y-junctions.

32. The method of claim 19 further comprising the step of symmetrically loading each junction with a shunt capacitor and series inductors.

33. The method of claim 19 further comprising the steps of:

forming each junction with two electrically symmetrical internal ports and an external port; and characterizing each junction by a matrix $S_T$ of scattering coefficients $r,s,r_d,s_d$:

$$S_T=\begin{pmatrix} r & s & s_d \\ s & r & s_d \\ s_d & s_d & r_d \end{pmatrix}$$

wherein:

$$r=\frac{1}{2}(s_a+s_b\cos^2\gamma+s_c\sin^2\gamma)$$

$$s=\frac{1}{2}(-s_a+s_b\cos^2\gamma+s_c\sin^2\gamma)$$

$$r_d=s_b\sin^2\gamma+s_c\cos^2\gamma$$

$$s_d=\frac{1}{\sqrt{2}}(s_b-s_c)\cos\gamma\sin\gamma$$

and wherein $s_a$, $s_b$, and $s_c$ are the eigenvalues of unit magnitude for the matrix $S_T$, and γ is the degeneracy parameter which results from the symmetry of the internal ports;

said coefficient r being the proportional part of a signal incident upon one of the symmetrical internal ports which flows out of the same symmetrical internal port, said coefficient $r_d$ being the proportional part of a signal incident upon one of the external ports which flows out of the same external port, said coefficient s being the proportional part of a signal incident upon one of said symmetrical internal ports which flows out of the opposite symmetrical internal port, and said coefficient $s_d$ being the proportional part of a signal incident upon one of the symmetrical internal ports which flows out of the adjacent external port.

34. The method of claim 33 further comprising the step of selecting the ideal average phase factor $\epsilon$ required by the non-reciprocal phase shifters for ideal circulation within the band from the set of solutions $\epsilon$ to the condition:

$$A_8\epsilon^8+A_6\epsilon^6+A_4\epsilon^4+A_2\epsilon^2+A_0=0,$$

wherein:

$$A_8=A_0^*=a_4a_0^*$$

$$A_6=A_2^*=a_4a_2^*+a_2a_0^*-a_3a_1^*$$

$$A_4=|a_4|^2+|a_2|^2+|a_0|^2-|a_3|^2-|a_1|^2$$

and:

$$a_4=(r-s)^3(r+s)$$

$$a_3=-s(r-s)^2$$

$$a_2=-2r(r-s)$$

$$a_1=s$$

$$a_0=1$$

and r and s are two of the four reflection and transmission coefficients of the junctions.

35. The method of claim 34 further comprising the step of selecting the differential phase factor $\delta$ required by the non-reciprocal phase shifters to produce circulation within the band from the set of solutions to the condition:

$$\delta^3=\frac{a_4\epsilon^4+a_2\epsilon^2+a_0}{a_3\epsilon^3+a_1\epsilon}.$$

36. The method of claim 33 further comprising the steps of forming the junctions as Y-junctions and selecting the capacitive susceptance $\omega C$ and inductive reactance $\omega L$ of the junctions such that they are related to the reflection coefficient r and transmission coefficient s according to the conditions:

$$r=\frac{-1+j[-\eta+\zeta(3-n\zeta)]}{3-2\eta\zeta+j[\eta+\zeta(3-\eta\zeta)]}$$

$$s=\frac{2}{3-2\eta\zeta+j[\eta+\zeta(3-\eta\zeta)]}$$

where $\eta$ is the capacitive susceptance parameter, $\eta=\omega CZ_0$; $\zeta$ is the inductive reactance parameter, $\zeta=\omega L/Z_0$; $Z_0$ is the characteristic impedance of the external ports; $j=\sqrt{-1}$; and $\omega$ is the radian frequency of the incident microwave signal.

37. The method of claim 19 wherein the step of correlating further comprises correlating over a bandwidth of 10% about the band center.

38. An electromagnetic circulator comprising:

a plurality of junctions; each junction having an external port for transmitting and receiving electromagnetic signals; each junction having a predetermined frequency-dependent inductive reactance and capacitive susceptance so that each individual junction partially reflects incident signals in a predetermined frequency-dependent manner; and a like plurality of non-reciprocal phase shifters comprising meanderline delay lines electrically interconnecting the junctions and a magnetic structure proximal to the delay lines having a magnetization which interacts with the magnetic field of the electromagnetic signals traversing the delay lines, inducing phase shift in the signal, the phase shift being dependent on the direction of propagation of the signals, such that the phase shift is non-reciprocal; the meanderlines being oriented tangentially about the ring network formed by the interconnected junctions and phase shifters; the phase shifters having a frequency-dependent average phase shift and differential phase shift which are correlated with the frequency-dependent characteristics of the reactance and susceptance of the junctions over a band of frequencies such that the interconnected junctions and phase shifters form a circulator which produces circulation of signals of frequencies within the band incident on an external port, the reflected signals at the junctions substantially reinforcing each other at an adjacent external transmitting port and substantially cancelling each other in the remainder of the junctions.

39. An electromagnetic circulator comprising:

a plurality of junctions; each junction having an external port for transmitting and receiving electromagnetic signals; each junction having a predetermined frequency-dependent inductive reactance and capacitive susceptance so that each individual junction partially reflects incident signals in a predetermined frequency-dependent manner; and a like plurality of non-reciprocal phase shifters electrically interconnecting the junctions; the phase shifters having a frequency-dependent average phase shift and differential phase shift which are correlated with the frequency-dependent characteristics of the reactance and susceptance of the junctions over a band of frequencies of at least approximately 10% about a band center such that the interconnected junctions and phase shifters form a ring network circulator which produces circulation of signals of frequencies within the band incident on an external port, the reflected signals at the junctions substantially reinforcing each other at an adjacent external transmitting port and substantially cancelling each other in the remainder of the junctions.

40. The electromagnetic circulator of claim 39 wherein the junctions and delay lines are formed of superconductors operating in a superconducting state, and the magnetic flux magnetization is substantially confined within the structure so that the flux does not substantially permeate the superconductor.

41. The electromagnetic circulator of claim 39 wherein the delay lines comprise comb filters.

42. The electromagnetic circulator of claim 39 wherein the inductive reactance and capacitive susceptance of each junction are selected to minimize the differential phase shift required between junctions to produce substantially ideal circulation at the designated band center.

43. The electromagnetic circulator of claim 39 wherein the junctions are T-junctions.

44. The electromagnetic circulator of claim 39 wherein the junctions are Y-junctions.

45. The electromagnetic circulator of claim 39 wherein each junction is symmetrically loaded by a shunt capacitor and series inductors.

46. An electromagnetic circulator comprising:

a plurality of junctions formed of superconductor material; each junction having an external port for transmitting and receiving electromagnetic signals; each junction having a predetermined frequency-dependent inductive reactance and capacitive susceptance so that each individual junction partially reflects incident signals in a predetermined frequency-dependent manner; and a like plurality of non-reciprocal phase shifters comprising delay lines formed of superconductor material electrically interconnecting the junctions and a magnetic structure proximal to the delay lines having a magnetic flux magnetization which is substantially confined within the structure such that the flux does not substantially permeate the superconductor junctions and phase shifters; the magnetization interacting with the magnetic field of the electromagnetic signals traversing the delay lines, inducing phase shift in the signals, the phase shift being dependent on the direction of propagation of the signals, such that the phase shift is non-reciprocal; the phase shifters having a frequency-dependent average phase shift and differential phase shift which are correlated with the frequency-dependent characteristics of the reactance and susceptance of the junctions over a band of frequencies such that the interconnected junctions and phase shifters form a circulator which produces circulation of signals of frequencies within the band incident on an external port, the reflected signals at the junctions substantially reinforcing each other at an adjacent external transmitting port and substantially cancelling each other in the remainder of the junctions.

47. The electromagnetic circulator of claim 46 wherein the magnetic structure is formed in the shape of a thin, self-biased disk having a magnetization directed normal to the surface of the disk.

48. The electromagnetic circulator of claim 46 wherein the magnetic structure is formed in the shape of a toroid.

49. The electromagnetic circulator of claim 48 wherein the toroidal magnetic structure includes a control wire disposed through a hole in the toroid for conducting current which induces a tangential magnetization in the structure; the direction and strength of the magnetization being a function of the direction and strength of the current conducted by the control wire.

50. The electromagnetic circulator of claim 49 wherein the magnetization in the magnetic structure is remanent after current is removed from the control wire.

51. An electromagnetic circulator comprising:

a plurality of junctions; each junction having an external port for transmitting and receiving electromagnetic signals; each junction having a predetermined frequency-dependent inductive reactance and capacitive susceptance so that each individual junction partially reflects incident signals in a predetermined frequency-dependent manner; and a like plurality of non-reciprocal phase shifters electrically interconnecting the junctions; the phase shifters having a frequency-dependent average phase shift and differential phase shift which are correlated with-the frequency-dependent characteristics of the reactance and susceptance of the junctions over a band of frequencies such that the interconnected junctions and phase shifters form a ring network circulator which produces circulation of signals of frequencies within the band incident on an external port, the inductive reactance and capacitive susceptance of each junction being selected to minimize the corresponding differential phase shift required between junctions to provide circulation within the band, the reflected signals at the junctions substantially reinforcing each other at an adjacent external transmitting port and substantially cancelling each other in the remainder of the junctions.

* * * * *

UNITED STATES PATENT AND TRADEMARK OFFICE

CERTIFICATE OF CORRECTION

PATENT NO. : 5,608,361
DATED : March 4, 1997
INVENTOR(S) : Jerald A. Weiss and Gerald F. Dionne It is certified that error appears in the above-indentified patent and that said Letters Patent is hereby corrected as shown below:

Claim 16, line 60, replace "$a_4$ $a_{o*}$" with ---$a_4$ $a_o$*---

Claim 21, line 66, replace "claim 19" with ---claim 20---.

Claim 50, line 26, replace "with-the" with ---with the---.

Signed and Sealed this

Tenth Day of June, 1997

*Attest:*

*Attesting Officer*

BRUCE LEHMAN

*Commissioner of Patents and Trademarks*